US009601043B2

(12) United States Patent
Hikichi et al.

(10) Patent No.: US 9,601,043 B2
(45) Date of Patent: Mar. 21, 2017

(54) DISPLAY DEVICE AND DISPLAY DRIVER WITH SEQUENTIAL TRANSFER OF GRAY SCALE REFERENCE VOLTAGES

(71) Applicant: Synaptics Japan GK, Tokyo (JP)

(72) Inventors: Toshiyuki Hikichi, Tokyo (JP); Yasuhito Kurokawa, Tokyo (JP); Shutaro Ichikawa, Tokyo (JP); Masashi Takata, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 67 days.

(21) Appl. No.: 14/502,415

(22) Filed: Sep. 30, 2014

(65) Prior Publication Data

US 2015/0109348 A1 Apr. 23, 2015

(30) Foreign Application Priority Data

Oct. 18, 2013 (JP) ..... 2013-217242

(51) Int. Cl.

| | |
|---|---|
| ***G09G 5/10*** | (2006.01) |
| ***G09G 3/20*** | (2006.01) |
| ***G09G 3/36*** | (2006.01) |

(52) U.S. Cl.

CPC ..... *G09G 3/20* (2013.01); *G09G 3/3688* (2013.01); *G09G 3/3696* (2013.01); *G09G 2310/0221* (2013.01); *G09G 2320/0276* (2013.01); *G09G 2320/0693* (2013.01)

(58) Field of Classification Search

None

See application file for complete search history.

(56) References Cited

U.S. PATENT DOCUMENTS

| | | | | |
|---|---|---|---|---|
| 2002/0044142 | A1 | 4/2002 | Fukuda | |
| 2009/0179922 | A1 * | 7/2009 | Kurihara | G09G 3/3648 345/690 |
| 2010/0013869 | A1 | 1/2010 | Matsumoto | |
| 2014/0184670 | A1 * | 7/2014 | Jeong | G09G 3/2003 345/694 |

FOREIGN PATENT DOCUMENTS

| | | |
|---|---|---|
| JP | 2010-026138 A | 2/2010 |
| WO | WO 01/57839 A1 | 8/2001 |

* cited by examiner

*Primary Examiner* — Amr Awad
*Assistant Examiner* — Donna Lui
(74) *Attorney, Agent, or Firm* — Miles & Stockbridge P.C.

(57) ABSTRACT

The display device includes display drivers including first and second ones operable to output, based on display data, gradation signals to source lines of display panel regions. The display device is arranged to be able to suppress the variation in output voltage between display drivers while minimizing the increases in chip area of the display drivers and in wiring area of a display panel and keeping high noise resistance. Each display driver can generate gray scale reference voltages for producing gradation signals corresponding to display data. The first display driver can sequentially transmit gray scale reference voltages generated by itself to the second display driver. Based on the transmitted gray scale reference voltages, the second display driver makes the first display driver execute calibration for decreasing the absolute value of difference between gray scale reference voltages generated by the first and second display drivers, or executes the calibration by itself.

25 Claims, 14 Drawing Sheets

(a) Phase A (b) Phase B

DISPLAY DEVICE AND DISPLAY DRIVER WITH SEQUENTIAL TRANSFER OF GRAY SCALE REFERENCE VOLTAGES

CROSS-REFERENCE TO RELATED APPLICATIONS

The Present application claims priority from Japanese application JP 2013-217242 filed on Oct. 18, 2013, the content of which is hereby incorporated by reference into this application.

BACKGROUND

The present invention relates to a display device and a display driver included therein, especially a display driver which can be suitably used for a display device arranged to achieve a display of high image quality by use of a plurality of display driver ICs (IC: Integrated Circuit).

In recent years, the resolution of display devices is becoming increasingly higher, and their sizes are becoming larger. With the progress of such rise in resolution and upsizing, it becomes more difficult to drive a display device by a one-chip display driver, accelerating the tendency to use multiple chips (i.e. a multi-chip) instead thereof. Using multiple chips has the problem that variation among display drivers in output voltage causes a difference in brightness in a display panel and therefore, resulting in decline in image quality.

The Japanese Unexamined Patent Application Publication No. JP-A-2010-26138 discloses a technique for preventing the decline in display quality of a liquid crystal display device operable to activate a display region by drive circuit components in cooperation with one another. According to the technique, based on a gradation reference voltage generated by one drive circuit component, a gradation reference voltage for other ones is generated. Now, it is noted that the gradation reference voltage herein refers to a voltage for producing output voltages to be output to a display panel from the drive circuit components, which is to be used as a reference in producing gradation voltages. The technique is expected to enable the suppression of the variation in output voltage. This is because the output voltages are produced based on a common gradation reference voltage.

International Publication WO01/057839 discloses a technique for preventing the decline of display quality by suppressing a source voltage drop between display drivers in a display device including a display driver of a master mode and a display driver of a slave mode. Gradation voltages are supplied from the display driver of the master mode to the display driver of the slave mode. Providing voltage follower circuits on transmit and receive sides respectively, the output impedance can be lowered, whereas the input impedance can be raised. Therefore, any voltage drop in a gradation voltage is barely caused in a transmission path. Accordingly, it is expected that the decline in display quality can be prevented by preventing the occurrence of bias deviation, and unevenness between blocks in a screen of a display device (see Page 14 of WO01/057839).

The above patent documents JP-A-2010-26138 and WO01/057839 are taken as examples of techniques which offer solutions to the problem of the decline of image quality.

SUMMARY

From the study of JP-A-2010-26138 and WO01/057839, the inventor found that there are new problems as follows.

In the display device disclosed by JP-A-2010-26138, an attempt to suppress the variation in output voltage among the drive circuit components is made by exchanging only a gradation reference voltage between drive circuit components (display drivers). The gradation reference voltage is a voltage used as a reference in generating gradation voltages, which just means that an analog signal of one line, namely a reference potential at one point is shared by drive circuit components. Based on the shared gradation reference voltage, the drive circuit components generate gradation voltages. As described in Paragraphs No. 0143 to 0155 of the document JP-A-2010-26138 with reference to FIG. 9 thereof, the drive circuit components perform correction for imparting a predetermined gamma characteristic to the relation between display data and gradation signal levels by performing a tilt adjustment and an amplitude adjustment. Even under the condition that a gradation reference voltage is arranged to be used commonly, the variation in output voltage can be caused among the drive circuit components in case that there is any variation among the gamma correction circuits.

In contrast, in the display device disclosed by WO01/057839, gradation voltages are provided from the master display driver to the slave display driver, whereby all the gradation voltages can be put in line with the same voltage.

However, in this case, it is necessary to transmit the gradation voltages, which causes problems as described below.

The first problem is that the number of wiring lines on the substrate of a display panel is increased. The line number of gradation voltages depends on the number of gradations of display data. Therefore, the line number of gradation voltages can be tens to hundreds or larger. The increase in the area occupied by such wiring lines can interfere with the downsizing, and raise the cost.

The second problem is that in the case of materializing such display drivers in the forms of ICs, the area of the chips is increased, and the cost is raised. As described above, the line number of gradation voltages is large, which increases the number of master-side pads for outputting the gradation voltages and the number of slave-side pads for receiving the gradation voltages. The increase in the number of pads on the either side can increase the chip area, and raise the cost. In addition, if the wiring lines for gradation voltages are long in length, it is necessary for the display drivers to include lots of output circuits each having a driving capacity adequate for driving the wiring line. The arrangement like this can increase the area of the chips and raise the cost as well.

The third problem is that the influence of noise mixed in a gradation voltage supplied from the master display driver to the slave one reaches the slave display driver, which can cancel out the effect of sharing a gradation voltage, and cause the decline in display quality. This is a common problem to the technique described in JP-A-2010-26138.

It is an object of the invention to suppress the variation in output voltage between display drivers while minimizing the increase in chip area of the display drivers and the increase in wiring area of a display panel and keeping high noise resistance.

While the means for solving these problems will be described below, other problems and novel features will become apparent from the description hereof and the accompanying drawings.

One embodiment is as follows.

The display device has a plurality of display drivers including first and second display drivers capable of outputting gradation signals to source lines for regions of a display panel based on display data. Each display driver is capable of generating gray scale reference voltages for producing gradation signals corresponding to the display data. The first display driver is capable of sequentially transmitting gray scale reference voltages generated by itself to the second display driver. Based on the gray scale reference voltages thus transmitted, the second display driver performs, by itself, or has the first display driver execute calibration for making smaller an absolute value of difference between gray scale reference voltages which are generated by the first and second display drivers respectively. Now, it is noted that "gray scale reference voltages" described herein may be exactly the aforementioned gradation voltages, or may be reference voltages at specific points which are supplied to arrange gradation voltages to have a desired gamma characteristic.

The effect achieved by the embodiment will be briefly described below.

It is possible to suppress the variation in output voltage between display drivers while minimizing the increase in chip area of the display drivers and the increase in wiring area of a display panel and keeping high noise resistance.

DETAILED DESCRIPTION

1. Summary of the Embodiments

Figure 1:
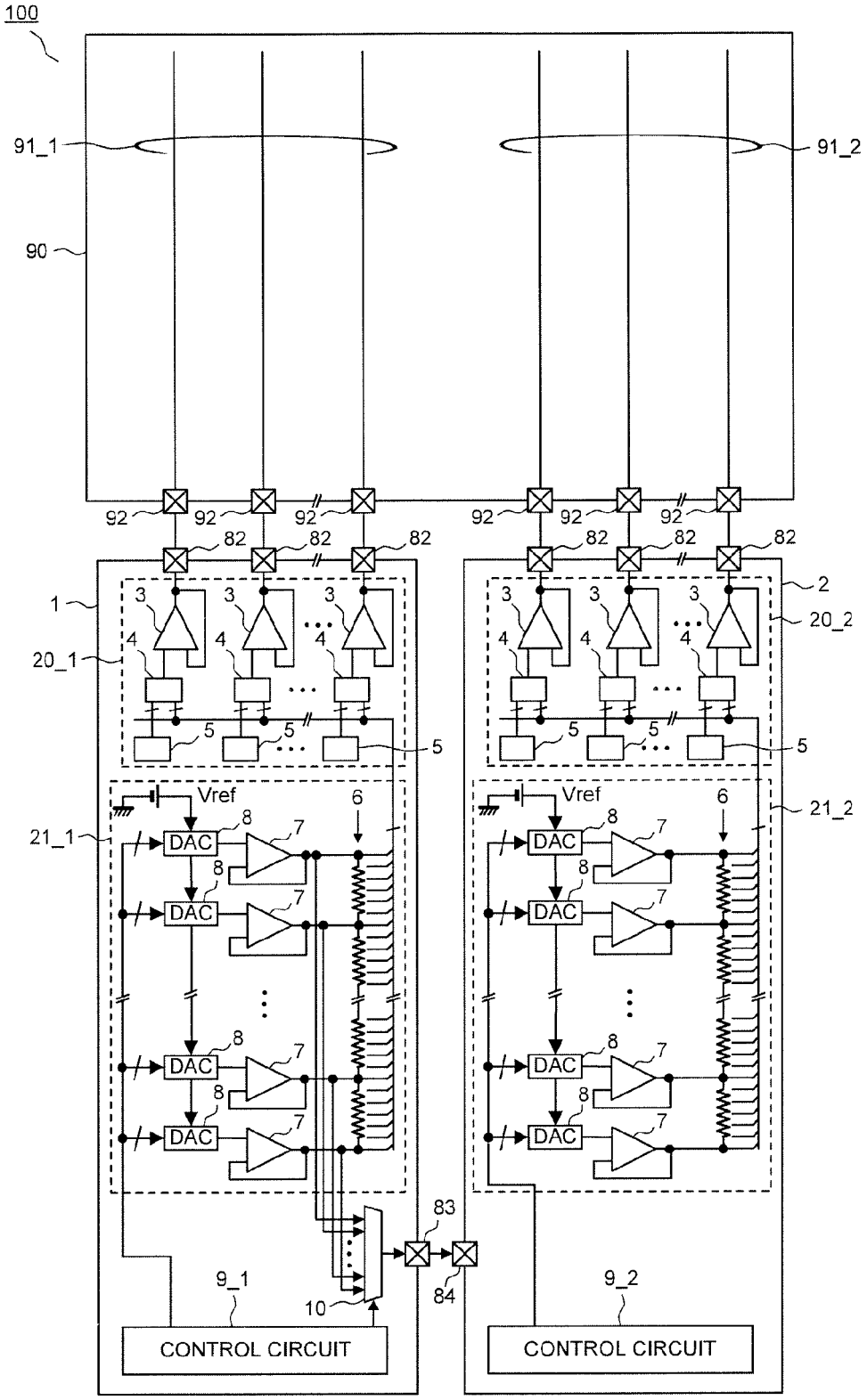
FIG. 1 is a block diagram showing an example of the configuration of a display device according to the invention.

First, summary of representative embodiments of the invention disclosed in the application will be described. Reference numerals in drawings in parentheses referred to in description of the summary of the representative embodiments just denote components included in the concept of the components to which the reference numerals are designated.

[1] <Display Device which Sequentially Transmits Gray Scale Reference Voltages to Display Drivers>

A display device (100) according to one representative embodiment of the invention includes: a first display driver (1) capable of outputting gradation signals to source lines (91_1) of a display panel (90) based on display data; and a second display driver (2) capable of outputting gradation signals to other source lines (91_2) of the display panel. The display device is arranged as follows.

The first and second display drivers are each capable of generating gray scale reference voltages for producing gradation signals corresponding to the display data (7, 8).

The first display driver is capable of sequentially transmitting gray scale reference voltages generated by itself to the second display driver (10, 83).

The second display driver is capable of executing calibration for making smaller an absolute value of difference between gray scale reference voltages which are generated by the first and second display drivers respectively based on the sequentially transmitted gray scale reference voltages.

According to the embodiment like this, it is possible to provide a display device arranged so that the variation in output voltage between display drivers can be suppressed while minimizing the increase in chip area of the display drivers and the increase in wiring area of a display panel and keeping high noise resistance.

[2] <Send Back Calibration Values Calculated by the Second Display Driver (Master) to the First Display Driver (Slave) (FIG. 2)>

In the display device as described in [1], the second display driver is capable of comparing the sequentially transmitted gray scale reference voltages with corresponding ones of the gray scale reference voltages generated by itself, calculating a calibration value based on the result of the comparison (29), and transmitting the calibration value to the first display driver (85, 86).

The first display driver is capable of changing gray scale reference voltages generated by itself based on the transmitted calibration value (30).

The embodiment like this makes possible to provide a display device arranged so that a master (second) display driver calculates a calibration value, and a slave (first) display driver performs calibration to a direction for making gray scale reference voltages generated by itself coincide with those of the master side. The master (second) display driver compares gray scale reference voltages sequentially transmitted from the slave (first) display driver with gray scale reference voltages generated by itself, calculates a calibration value, and sends back the calibration value to the slave (first) display driver, whereby the slave (first) display driver performs calibration to a direction for making gray scale reference voltages generated by itself coincide with those of the master side.

[3] <Slave (Third) Display Drivers (FIG. 3)>

The display device as described in [2] further includes: a third display driver (13) capable of outputting gradation signals to source lines (91_3) of the display panel different from the source lines (91_1, 91_2) to which the first display driver (1_1) and the second display driver (2) output gradation voltages.

The third display driver is capable of generating gray scale reference voltages for producing gradation signals corresponding to the display data (21_3).

The third display driver is capable of sequentially transmitting the gray scale reference voltages generated by itself to the second display driver (22_3, 83_3, 84).

The second display driver is capable of comparing the sequentially transmitted gray scale reference voltages with corresponding ones of the gray scale reference voltages generated by itself, calculating a calibration value based on the result of the comparison (29), and transmitting the calibration value to the third display driver (85, 86_3).

The third display driver is capable of changing gray scale reference voltages generated by itself based on the transmitted calibration value (30_3).

According to the embodiment like this, it is possible to suppress the variation in output voltage between display drivers while minimizing the increase in chip area of the display drivers and the increase in wiring area of a display panel and keeping high noise resistance in a display device including a master (second) display driver and slave (e.g. first and third) display drivers. The slave (e.g. first and third) display drivers send, to the master (second) display driver, gray scale reference voltages sequentially produced by themselves; the master display driver sequentially calculates calibration values, and sends them back to the slave display drivers. On receipt of them, the slave display drivers change gray scale reference voltages generated by themselves based on the calibration values thus sent back.

[4] <Self-Calibration by the Second Display Driver (Slave) Based on Gray Scale Reference Voltages Transmitted from the First Display Driver (Master) (FIG. 4)>

In the display device as described in [1], the second display driver is capable of comparing the sequentially transmitted gray scale reference voltages with corresponding ones of the gray scale reference voltages generated by itself (29), and changing the gray scale reference voltages generated by itself based on the result of the comparison (30).

According to the embodiment like this, it is possible to provide a display device arranged so that the slave (second) display driver performs autonomous calibration based on gray scale reference voltages transmitted from the master (first) display driver to a direction to make gray scale reference voltages generated by itself coincide with those of the master side. The slave (second) display driver compares gray scale reference voltages sequentially transmitted from the master (first) display driver with gray scale reference voltages generated by itself, thereby performing calibration to a direction for making gray scale reference voltages generated by itself coincide with those of the master side.

[5] <Parallel Self-Calibrations by Slave (e.g. Second and Fourth) Display Drivers (FIG. 5)>

The display device as described in [4] further includes: a fourth display driver (2_3) capable of outputting gradation signals to source lines (91_3) of the display panel different from the source lines (91_1, 91_2) to which the first display driver (1) and the second display driver (2_2) output gradation voltages.

The fourth display driver is capable of generating gray scale reference voltages for producing gradation signals corresponding to the display data (21_3).

The first display driver is capable of sequentially transmitting the gray scale reference voltages generated by itself to the second and fourth display drivers in parallel (83, 84_2, 84_3).

The second display driver is capable of comparing the sequentially transmitted gray scale reference voltages with corresponding ones of the gray scale reference voltages generated by itself (18_2), and changing gray scale reference voltages generated by itself based on a result of the comparison (30_2).

Likewise, the fourth display driver is capable of comparing the sequentially transmitted gray scale reference voltages with corresponding ones of the gray scale reference voltages generated by itself (18_3), and changing gray scale reference voltages generated by itself based on a result of the comparison (30_3).

According to the embodiment like this, it is possible to suppress the variation in output voltage between display drivers while minimizing the increase in chip area of the display drivers and the increase in wiring area of a display panel and keeping high noise resistance in a display device including a master (first) display driver and slave (e.g. second and fourth) display drivers. The master (first) display driver sequentially sends gray scale reference voltages generated by itself to the slave (e.g. second and fourth) display drivers in parallel; the slave (e.g. second and fourth) display drivers perform control to bring gray scale reference voltages produced by themselves close to the received gray scale reference voltages respectively.

[6] <Calibration in Digital (FIGS. 6 to 9)>

In the display device as described in any one of [1] to [5], the second display driver includes an analog-to-digital converter (13), a memory circuit (17), and a calculation circuit (18), and is arranged as described below.

The analog-to-digital converter is capable of converting gray scale reference voltages generated by the second display driver, and the sequentially transmitted gray scale reference voltages into digital values on an as-needed basis; the memory circuit is capable of storing the digital values; and the calculation circuit is capable of executing the calibration by reading out digital values stored in the memory circuit, and executing a comparison and/or division.

According to the embodiment like this, the second display driver which has received gray scale reference voltages calculates, by means of digital processing, a calibration value in the cases of [2] and [3]; the second display driver can calibrate, by means of digital processing, gray scale voltages of its own in the cases of [4] and [5].

[7] <Calibration in Analog (FIGS. 10 to 13)>

In the display device as described in any one of [1] to [5], the second display driver includes an analog comparator (14), a memory circuit (17), and a calculation circuit (19), and is arranged as described below.

The analog comparator is capable of comparing gray scale reference voltages generated by the second display driver with the transmitted gray scale reference voltages respectively; the memory circuit is capable of storing a result of the comparison; and the calculation circuit is capable of executing the calibration by reading out results of the comparison stored in the memory circuit, and executing a calculation.

According to the embodiment like this, the second display driver which has received gray scale reference voltages can calculate, by means of digital processing, a calibration value in the cases of [2] and [3]; the second display driver can calibrate, by means of digital processing, gray scale voltages of its own in the cases of [4] and [5].

[8] <Offset Cancel of the Analog Comparator (FIG. 11)>

In the display device as described in [7], the second display driver further includes a switch (15) capable of mutually switching between inputs of the analog comparator to each other.

In case that gray scale reference voltages generated by the second display driver are input to one input terminal of the analog comparator, and the transmitted gray scale reference voltages are input to the other input terminal of the analog comparator, a first comparison result is stored in the memory circuit.

In case that as a result of switching the switch, the transmitted gray scale reference voltages are input to the one input terminal of the analog comparator, and gray scale reference voltages generated by the second display driver are input to the other input terminal of the analog comparator, a second comparison result is stored in the memory circuit.

The calculation circuit is capable of executing the calibration based on the first and second comparison results.

According to the embodiment like this, the calculation circuit is used to execute a calculation for cancelling an input offset of the analog comparator, whereby the calibration can be executed more correctly.

[9] <Calibration at Power-On>

In the display device as described in any one of [1] to [8], the calibration can be executed at power-on.

According to the embodiment like this, the calibration appropriate for aged deterioration can be executed.

[10] <Calibration in a Line-Return Period of Display>

In the display device as described in [9], the calibration can be further executed during a line-return period of display.

According to the embodiment like this, the calibration can be executed successively during the time display.

[11] <Non-Volatile Memory Calibration for Holding Results>

The display device as described in any one of [1] to [8] includes a non-volatile memory capable of holding a result of the calibration.

According to the embodiment like this, gray scale reference voltages calibrated before shipment can be reproduced even after the shipment as long as the calibration is executed and the result is held in a before-shipment test on the display device.

[12] <Second Display Driver (Slave) Samples and Holds Gray Scale Reference Voltages Transmitted from the First Display Driver (Master) (FIGS. 14, 15)>

In the display device as described in [1], the second display driver includes sample&hold circuits (23) corresponding to the gray scale reference voltages, and is capable of sampling and holding the transmitted gray scale reference voltages in the corresponding sample&hold circuits. The second display driver is capable of generating its own gray scale reference voltages based on the held gray scale reference voltages.

According to the embodiment like this, it is made possible just by adding a simple circuit to perform control so as to copy gray scale reference voltages generated by the master (first) display driver to the slave (second) display driver, and so as to generate gray scale reference voltages comparable to those in the master side.

[13] <Display Driver Capable of Sequentially Outputting Gray Scale Reference Voltages>

A display driver (1, 1_1, 1_3) is capable of outputting gradation signals to a group of source lines (91_1) of a display panel (90) based on display data, and is arranged as described below.

The display driver is capable of being mounted on a display device (100) together with an additional display driver (2) capable of outputting gradation signals to a second group of source lines (91_2) of the display panel.

Each of the display driver and the additional display driver is capable of generating gray scale reference voltages for producing gradation signals corresponding to the display data (21_1, 21_2).

The display driver is capable of sequentially transmitting the gray scale reference voltages generated by itself to the additional display driver (83, 84).

At least one of the display driver and the additional display driver is capable of executing calibration so as to make smaller the absolute value of difference between gray scale reference voltages generated by the display drivers based on the transmitted gray scale reference voltages (30).

According to the embodiment like this, it is possible to provide a display driver to be incorporated in a display device arranged so that the variation in output voltage between display drivers can be suppressed while minimizing the increase in chip area of the display drivers and the increase in wiring area of a display panel and keeping high noise resistance.

[14] <Slave Display Driver which Receives a Calibration Value from the Master One (FIGS. 2 and 3)>

In the display driver as described in [13], the additional display driver (2) is capable of comparing the transmitted gray scale reference voltages with gray scale reference voltages generated by itself thereby to calculate a calibration value for making smaller the absolute value of the difference (29), and transmitting the calibration value to the display driver (85, 86).

The display driver is capable of calibrating the gray scale reference voltages generated by itself based on the transmitted calibration value (30).

According to the embodiment like this, it is possible to provide a slave display driver which receives a calibration value from the master, and calibrates the gray scale reference voltages generated by itself.

[15] <Master Display Driver which Makes the Slave Execute Calibration (FIGS. 4 and 5)>

In the display driver as described in [13], the additional display driver (2, 2_2, 2_3) is capable of calibrating the gray scale reference voltages generated by itself (30) in order to make smaller the absolute value of the difference by comparing the transmitted gray scale reference voltages with gray scale reference voltages generated by itself (18).

According to the embodiment like this, it is possible to provide a slave display driver which receives a calibration value from the master, and calibrates the gray scale reference voltages generated by itself.

[16] <Display Driver Capable of Sequentially Receiving Gray Scale Reference Voltages>

A display driver (2) is capable of outputting gradation signals to a group of source lines (91_2) of a display panel (90) based on display data, and is arranged as described below.

The display driver capable of being mounted on a display device (100) together with an additional display driver (1) capable of outputting gradation signals to a second group of source lines (91_1) of the display panel.

Each of the display driver and the additional display driver is capable of generating gray scale reference voltages for producing gradation signals corresponding to the display data (21_1, 21_2).

The display driver is capable of sequentially receiving the generated gray scale reference voltages from the additional display driver (84), and comparing received gray scale reference voltages with gray scale reference voltages generated by itself (18).

At least one of the display driver and the additional display driver is capable of executing calibration (30) so as to make smaller the absolute value of difference between gray scale reference voltages generated by the display drivers based on a result of the comparison.

According to the embodiment like this, it is possible to provide a display driver to be incorporated in a display device arranged so that the variation in output voltage between display drivers can be suppressed while minimizing the increase in chip area of the display drivers and the increase in wiring area of a display panel and keeping high noise resistance.

[17] <Master Display Driver that Calculates and Sends Back a Calibration Value Based on Received Gray Scale Reference Voltages (FIGS. 2 and 3)>

The display driver (2) as described in [16] is capable of calculating, based on the comparison result, a calibration value for making smaller the absolute value of difference between gray scale reference voltages generated by the display divers (29), and transmitting the calibration value to the additional display driver (85).

The additional display driver (1, 1_1, 1_3) is capable of calibrating the gray scale reference voltages generated by itself based on the received calibration value (30, 30_1, 30_3).

According to the embodiment like this, it is possible to provide a master display driver which calculates and sends back a calibration value based on received gray scale reference voltages.

[18] <Slave Display Driver which Executes Calibration Based on Received Gray Scale Reference Voltages (FIGS. 4 and 5)>

The display driver (2, 2_2, 2_3) as described in [16] is capable of calibrating the gray scale reference voltages generated by itself in order to make smaller the absolute value of difference between gray scale reference voltages generated by the display drivers based on the comparison result (30, 30_2, 30_3).

According to the embodiment like this, it is possible to provide a slave display driver capable of executing calibration based on received gray scale reference voltages.

[19] <Display Driver Having a Master/Slave Action Mode Switchover (FIGS. 2 and 3)>

A display driver (1, 2) is capable of outputting gradation signals to a group of source lines of a display panel (90) based on display data, and is arranged as described below.

The display driver is capable of being mounted on a display device together with an additional display driver capable of outputting gradation signals to a second group of source lines of the display panel.

Each of the display driver and the additional display driver is capable of generating gray scale reference voltages for producing gradation signals corresponding to the display data (21_1, 21_2).

The display driver has action modes consisting of a master mode and a slave mode.

The display driver is capable of performing the actions below in the master mode.

That is, the actions include: sequentially receiving the generated gray scale reference voltages from the additional display driver operable to work in the slave mode (84); comparing received gray scale reference voltages with gray scale reference voltages generated by itself, and calculating, based on the comparison result, a calibration value for making smaller the absolute value of difference between gray scale reference voltages generated by the display drivers (29); and sending out the calibration value to the additional display driver (85).

The additional display driver is capable of calibrating the gray scale reference voltages generated by itself based on the received calibration value in the master mode (30).

The display driver is capable of performing the actions below in the slave mode.

That is, the display driver sequentially sends out the gray scale reference voltages generated by itself to the additional display driver operable to work in the master mode (83). The additional display driver is capable of: calculating a calibration value in order to make smaller the absolute value of the difference by comparing the transmitted gray scale reference voltages with gray scale reference voltages generated by itself (18); and transmitting the calibration value to the display driver (85). The display driver is capable of calibrating, based on the transmitted calibration value, the gray scale reference voltages generated by itself (30).

According to the embodiment like this, it is possible to provide a display driver having the functions as described in [14] (in the slave mode) and [17] (in the master mode), provided that the functions can be switched.

[20] <Display Driver Having Master/Slave Action Mode Switchover (FIGS. 4, 5)>

A display driver (1, 2) is capable of outputting gradation signals to a group of source lines of a display panel (90) based on display data and is arranged as described below.

The display driver is capable of being mounted on a display device together with an additional display driver capable of outputting gradation signals to a second group of source lines of the display panel.

Each of the display driver and the additional display driver is capable of generating gray scale reference voltages for producing gradation signals corresponding to the display data (21_1, 21_2).

The display driver has action modes consisting of a master mode and a slave mode.

The display driver is capable of performing the actions below in the master mode.

That is, the display driver is capable of sequentially transmitting the gray scale reference voltages generated by itself to the additional display driver operable to work in a slave mode (83).

The additional display driver is capable of comparing the transmitted gray scale reference voltages with gray scale reference voltages generated by itself (29), thereby calibrating the gray scale reference voltages generated by itself (30) in order to make smaller the absolute value of the difference.

The display driver is capable of performing the actions below in the slave mode.

The display driver is capable of sequentially receiving the generated gray scale reference voltages from the additional display driver operable to work in the master mode (84).

The display driver is capable of comparing received gray scale reference voltages with gray scale reference voltages generated by itself (18), and calibrating, based on the comparison result, the gray scale reference voltages generated by itself in order to make smaller the absolute value of difference between gray scale reference voltages generated by the display drivers (30).

According to the embodiment like this, it is possible to provide a display driver having the functions as described in [15] (in the master mode) and [18] (in the slave mode), provided that the functions can be switched.

[21] <Calibration in Digital (FIGS. 6 to 9)>

The display driver (2) as described in any one of [17] to [20] includes: an analog-to-digital converter (13); a memory circuit (17); and a calculation circuit (18) and is arranged as described below.

The analog-to-digital converter is capable of converting gray scale reference voltages generated by itself and the sequentially transmitted gray scale reference voltages into digital values on an as-needed basis; the memory circuit is capable of storing the digital values; and the calculation circuit is capable of executing the calibration by reading out digital values stored in the memory circuit, and executing a comparison and/or division.

According to the embodiment like this, the display driver having received gray scale reference voltages can calculate, by means of digital processing, a calibration value in the case of [17] and calibrate its own gray scale voltages in the case of [18]. In addition, the display driver can perform the comparison for calibration by means of digital processing in the master mode in the case of [19], and in the slave mode in the case of [20].

[22] <Calibration in Analog (FIGS. 10 to 13)>

In the display driver as described in any one of [17] to [20], the display driver (2) includes: an analog comparator (14); a memory circuit (17); and a calculation circuit (19), and is arranged as described below.

The analog comparator is capable of comparing gray scale reference voltages generated by the display driver with the transmitted gray scale reference voltages respectively on an as-needed basis; the memory circuit is capable of storing a result of the comparison; and the calculation circuit is capable of executing the calibration by reading out results of the comparison stored in the memory circuit, and executing a calculation.

According to the embodiment like this, the display driver having received gray scale reference voltages can calculate a calibration value in the case of [17], and calibrate its own gray scale voltages in the case of [18] by means of analog processing. In addition, it is possible to perform comparison for calibration in the master mode in the case of [19], and in the slave mode in the case of [20] by means of analog processing.

[23] <Offset Cancel of the Analog Comparator (FIG. 11)>

The display driver as described in [22] further includes a switch (15) capable of mutually switching between inputs of the analog comparator to each other In case that gray scale reference voltages generated by the display driver are input to one input terminal of the analog comparator, and the transmitted gray scale reference voltages are input to the other input terminal of the analog comparator, a first comparison result is stored in the memory circuit.

In case that as a result of switching the switch, the transmitted gray scale reference voltages are input to the one input terminal of the analog comparator, and gray scale reference voltages generated by the second display driver are input to the other input terminal of the analog comparator, a second comparison result is stored in the memory circuit.

The calculation circuit is capable of executing the calibration based on the first and second comparison results.

According to the embodiment like this, the calculation circuit is used to execute a calculation for cancelling an input offset of the analog comparator, whereby the calibration can be executed more correctly.

[24] <Non-Volatile Memory for Holding a Result of Calibration>

The display driver as described in any one of [13] to [23] includes a non-volatile memory capable of holding a result of the calibration.

According to the embodiment like this, it is possible to provide a display driver IC which allows gray scale reference voltages calibrated before shipment to be reproduced even after the shipment as long as the calibration is executed and the result is held in a before-shipment test thereof.

[25] <Display Driver that Samples and Holds Transmitted Gray Scale Reference Voltages (FIGS. 14 and 15)>

A display driver (1, 2) is capable of outputting gradation signals to a group of source lines of a display panel (90) based on display data, and is arranged as described below.

The display driver is capable of being mounted on a display device together with an additional display driver capable of outputting gradation signals to a second group of source lines of the display panel.

Each of the display driver and the additional display driver is capable of generating gray scale reference voltages for producing gradation signals corresponding to the display data (21_1, 21_2).

The display driver is capable of sequentially receiving the generated gray scale reference voltages from the additional display driver (84).

The display driver includes sample&hold circuits (23) corresponding to the gray scale reference voltages. Further, the display driver is capable of: sampling and holding the transmitted gray scale reference voltages in the corresponding sample&hold circuits; and generating its own gray scale reference voltages based on the held gray scale reference voltages.

According to the embodiment like this, it is made possible just by providing a simple circuit to offer a slave display driver capable of performing control so as to copy gray scale reference voltages generated by the master display driver to the slave display driver, and so as to generate gray scale reference voltages comparable to those in the master side.

[26] <Single Chip>

The display driver as described in any one of [13] to [25] is formed on a single semiconductor substrate.

According to the embodiment like this, it is possible to provide an integrated display driver IC.

2. Further Detailed Description of the Embodiments

The embodiments will be described further in detail.

First Embodiment

Display Device which Sequentially Transmits Gray Scale Reference Voltages Between Display Drivers FIG. 1 is a block diagram showing an example of the configuration of a display device 100 according to the invention.

The display device 100 includes: a first display driver 1 capable of outputting gradation signals to source lines 91_1 of a display panel 90 based on display data; and a second display driver 2 capable of outputting gradation signals to other plurality of source lines 91_2 of the display panel 90. The display device 100 is arranged as follows.

The first display driver 1 includes a source-line-driving part 20_1, a gradation-voltage-generation part 21_1, and a control circuit 9_1, and the second display driver 2 includes a source-line-driving part 20_2, a gradation-voltage-generation part 21_2, and a control circuit 9_2. In addition, each of the first and second display drivers 1 and 2 may include a circuit for driving gate lines of the display panel and an interface circuit with a host processor. The outputs of the source-line-driving parts 20_1 and 20_2 are electrically connected through source-line-drive output terminals 82 to source line drive terminals 92 of the display panel 90. The source-line-drive terminals 92 of the display panel 90 are connected to the source lines 91 directly or through e.g. a demultiplexer. The first display driver 1 supplies the source lines 91_1 with gradation signals output from the source-line-driving part 20_1. The second display driver 2 supplies the source lines 91_2 with gradation signals output from the source-line-driving part 20_2.

Although no special restriction is intended, the first and second display drivers 1 and 2 are each formed on a single semiconductor substrate of silicon or the like by e.g. the known CMOS semiconductor manufacturing technique (CMOS: Complementary Metal-Oxide-Semiconductor field effect transistor), which are flip chip-mounted on a glass substrate of the display panel 90. In this case, the terminals (82 to 87) of the first and second display drivers, shaped in pad electrodes, are electrically connected with bumps (protruding electrodes) and therefore, connected with terminals 92 on the side of the display panel 90.

The source-line-driving parts 20_1 and 20_2 output gradation signals for driving the source lines 91_1 and 91_2 based on gradation voltages supplied from the gradation-voltage-generation parts 21_1 and 21_2 respectively. The source-line-driving parts 20_1 and 20_2 each include: a plurality of source amplifiers 3; a plurality of gradation-voltage-select parts 4; and a plurality of latches 5. In the latches 5, display data are stored in the forms of digital values. The display data are data of e.g. 8 bits. The gradation-voltage-select parts 4 are supplied with gradation voltages provided from the gradation-voltage-generation parts 21_1 and 21_2. Further, based on display data input from the latches 5, the gradation-voltage-select parts 4 select one gradation from the gradation voltages, or select two gradations to output the intermediate value thereof, thereby producing gradation signals corresponding to input display data. The gradation voltages are of e.g. 80 gradations, adjacent two gradations of which are selected according to the most significant 6 to 7 bits of 8-bit display data, whereas gradation signals of intermediate potentials such as 0, 1/4, 2/4, 3/4 and 4/4 between the gradations are output according to the low-order 2 bits. The gradation voltage is e.g. 0 to 6 volts, and the latches 5 work on a low voltage, e.g. 1.3 volts, so a level-shift circuit is provided between each latch 5 and the corresponding gradation-voltage-select circuit 4, but it is not shown in the drawing. Gradation signals produced by the gradation-voltage-select circuits 4 are output to source-line-driving output terminals 82 through source amplifiers 3 composed of e.g. voltage follower amplification circuits.

The gradation-voltage-generation parts 21_1 and 21_2 each include: a plurality of DA converters 8; a plurality of voltage-follower-power amplifiers 7; and a resistance ladder 6. The plurality of DA converters 8 each convert a digital gray scale reference voltage set value which is supplied from the control circuit 9_1 or 9_2 or set on a register provided in an input part (not shown) into an analog gray scale reference voltage. Each DA converter 8 is supplied with a reference voltage Vref. An analog gray scale reference voltage, which is an output of each DA converter 8, is passed to the corresponding voltage-follower-power amplifier 7, and then coupled to a corresponding tap of the resistance ladder 6. The resistance ladder 6 is further divided between taps in resistance, whereby gradation voltages are produced. The gray scale reference voltages consist of ones of e.g. 15 levels, and a polygonal-line characteristic curve of gradation voltages is defined to approximate a gamma characteristic. The gamma characteristic is a feature which is determined based on the characteristics of the connected display panel 90, and represented by a characteristic curve showing the relation between display data and gradation signal levels. By setting the gray scale reference voltages, the gamma characteristic is approximated by a polygonal line.

The first display driver 1 is arranged so that it can transmit gray scale reference voltages generated by itself to the second display driver 2 in turn. For instance, the first display driver 1 has an analog multiplexer 10 provided therein, and it selects, by means of the control circuit 9_1, gray scale reference voltages in turn, and outputs them through the output terminals 83.

The second display driver 2 is arranged so that it can execute, based on gray scale reference voltage thus transmitted in turn, a calibration to make smaller an absolute value of difference between each gray scale reference voltage produced by the first display driver 1, and a gray scale reference voltage produced by the second display driver 2. Now, it is noted that the "calibration" may be executed by either of the first and second display drivers 1 and 2. While the detailed example will be described later, the difference between a gray scale reference voltage received by the second display driver 2 and a gray scale reference voltage produced by itself is determined by comparison. The display device may be arranged so that a calibration value is sent back to the first display driver 1 based on the difference and then, the first display driver 1 changes the gray scale reference voltage. Otherwise, the second display driver 2 may change the gray scale reference voltage produced by itself based on the difference.

Performing the calibration as described above, it is possible to make gray scale reference voltages produced by the first display driver 1 coincide with gray scale reference voltages produced by the second display driver 2. Here, the expression "to make something coincide with another" means that the two things are made the same or equal in a range permitting errors which normally occur in terms of industries. Even if the variation in output voltage between the display drivers can be caused by the variation in manufacturing between the first and second display drivers 1 and 2, or the difference in the source voltages supplied thereto, the variation can be suppressed by making the gray scale reference voltages coincide with each other.

In the case of the technique described in JP-A-2010-26138, only a gradation reference voltage which is an analog signal of one line is exchanged, and the reference voltages are made to coincide with each other, whereby an attempt to suppress the variation in output voltage between the display drivers (drive circuit components) is made. On the other hand, according to the invention, the gray scale reference voltages are all made to coincide with the others respectively, so the gamma characteristics of the display drivers can be made to coincide with each other. In other words, the variation in output voltage can be suppressed for any level of gradation signals.

Further, with the technique described in WO01/057839, all of gradation voltages can be made uniform by supplying the gradation voltages from a master display driver to a slave display driver; the technique requires input/output terminals and wiring lines on a display panel, both corresponding to the gradation voltages in number. In contrast, according to the invention, gradation voltages are transmitted in turn, so one pair of input/output terminals 83 and 84 and one wiring line on a display panel will do fine. Further, the calibration is completed before the start of a display action and therefore, even if noise enters a signal line to pass a gradation voltage to during a display action, which does not affect display.

As described above, it is possible to provide a display device arranged so that the variation in output voltage between display drivers can be suppressed while minimizing the increase in chip area of the display drivers and the increase in wiring area of a display panel and keeping high noise resistance.

The calibration action for making gray scale reference voltages of display drivers coincide with each other may be performed by a convergence method arranged so as to gradually lessen an error while repeating a comparison and a computation, or an analytical method arranged so as to calculate and feedback an error in one operation. To reduce the influence of noise during a period of calibration, a calibration value may be determined from an average value by performing calibrations, or it may be determined according to the majority decision rule.

The calibration for making gray scale reference voltages of display drivers coincide with each other is performed as part of power-up sequence at power-on of the display device, for example. In this way, even with the display device and/or either or both of the display drivers aged, the calibration can be performed to adapt to the aging. Further, the calibration may be executed in each display line-return period. At this time, the calibrations for all the gray scale reference voltages are not necessarily completed in one line-return period. Such calibrations may be performed over more than one line-return period sequentially. With the arrangement like this, calibrations can be executed sequentially even while keeping executing the display action, and even if the fluctuation in temperature or source voltage would cause the variation in the output voltages, the variation can be suppressed. The display drivers may each have a non-volatile memory capable of holding a result of the calibration therein or thereoutside. Data to input to the DA converters 8, which result from the calibrations as described above, are stored in the non-volatile memories; the input data can be read from there for reproduction of the calibrated gray scale reference voltages in action.

The calibration for making gray scale reference voltages of the display drivers coincide with each other may be executed as device trimming e.g. before shipment of a display device. The variation in output voltage between the display drivers is caused chiefly by the characteristics of the display drivers and the display panel, so it is sufficient to perform just the trimming before shipment as long as aged deterioration, temperature dependence, and source voltage dependence can be ignored. For a trimming value, e.g. a non-volatile memory may be provided in the display drivers or externally attached thereto to store the trimming value.

Now, the various forms of mounting the display device 100 according to the invention will be described.

<Send Back a Calibration Value Calculated by the Second Display Driver (Master) to the First Display Driver (Slave)>

Figure 2:
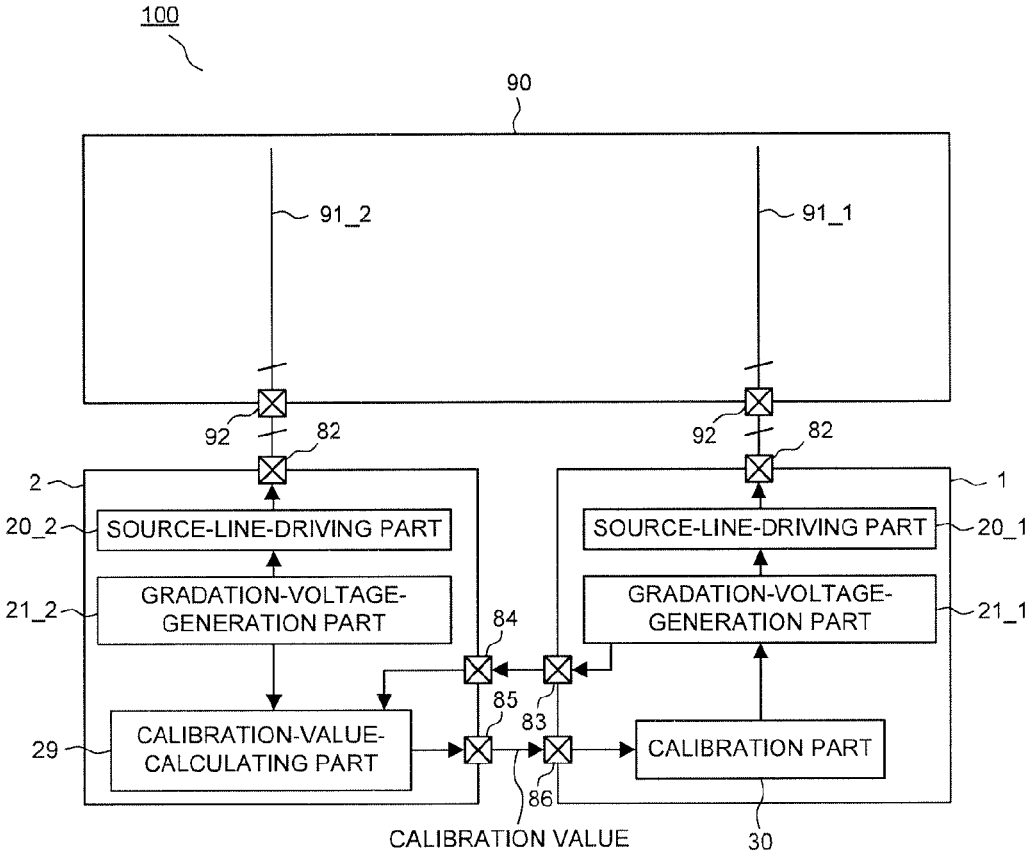
FIG. 2 is a schematic block diagram showing the first example of the configuration of the display device.

FIG. 2 is a schematic block diagram showing the first example of the configuration of the display device 100. The display device 100 includes a display panel 90, a second display driver 2 serving as a master, and a first display driver 1 serving as a slave. Now, it is noted that "master" refers to a display driver which provides a reference to use in calibration of gray scale reference voltages on condition that the display device has display drivers connected with the same display panel, and "slave" refers to a display driver which adjusts gray scale reference voltages generated by itself so as to coincide with gray scale reference voltages of the master. The definitions of these words shall be applied to the whole specification hereof.

The second display driver 2 is connected with source lines 91_2 of the display panel 90 through terminals 82 and 92. The first display driver 1 is connected with source lines 91_1 of the display panel 90 through terminals 82 and 92.

The second display driver 2 includes: a source-line-driving part 20_2; a gradation-voltage-generation part 21_2; a calibration-value-calculating part 29; a gray-scale-reference-voltage-input terminal 84; and a calibration-value-output terminal 85. The first display driver 1 includes: a source-line-driving part 20_1; a gradation-voltage-generation part 21_1; a calibration part 30; a gray-scale-reference-voltage-output terminal 83; and a calibration-value-input terminal 86. In the first display driver 1, the gradation-voltage-generation part 21_1 includes the multiplexer 10 shown in FIG. 1; gray scale reference voltages generated inside the gradation-voltage-generation part 21_1 are sequentially selected and output through the gray-scale-reference-voltage-output terminal 83.

The second display driver 2 compares, by means of the calibration-value-calculating part 29, gray scale reference voltages sequentially transmitted and received through the gray-scale-reference-voltage-input terminal 84 with corresponding ones of the gray scale reference voltages generated by itself, calculates a calibration value based on the result of the comparison, and outputs the calibration value through the calibration-value-output terminal 85. The first display driver 1 receives the calibration value through the calibration-value-input terminal 86, and calibrates, by means of the calibration part 30, gray scale reference voltages generated by itself based on the received calibration value.

Now, it is noted that the "calibration-value-calculating part" and the "calibration part" refer to circuit blocks which symbolize functions materialized by the control circuit 9 and other circuits, and such particular circuit blocks may not be mounted necessarily. This applies to the display devices shown in FIGS. 2 to 5.

Thus, it becomes possible to provide a display device 100 arranged so that a master (second) display driver 2 calculates a calibration value, and a slave (first) display driver 1 performs calibration to make gray scale reference voltages generated by itself coincide with those of the master side.

<Slave Display Drivers>

Figure 3:
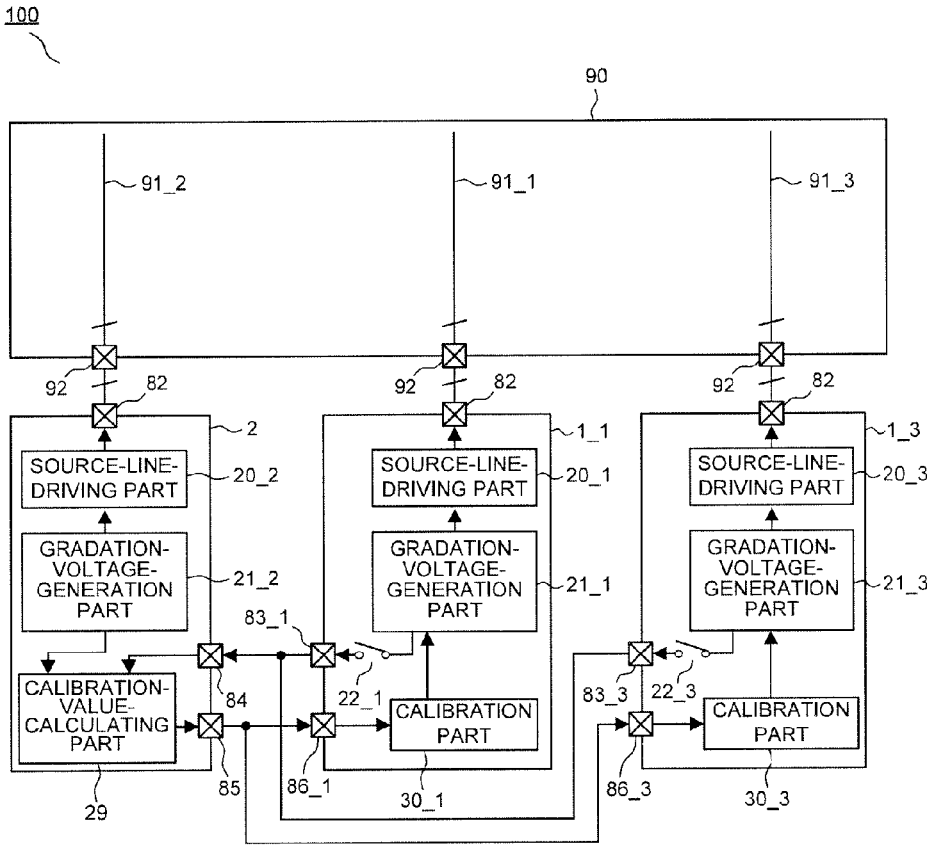
FIG. 3 is a schematic block diagram showing the second example of the configuration of the display device.

FIG. 3 is a schematic block diagram showing the second example of the configuration of the display device 100. Shown as an example of the configuration of the display device having one master (second) display driver 2 and a plurality of slaves is the configuration of a display device having two slaves, i.e. a first display driver 1_1 and a third display driver 1_3, provided that the number of the slaves is arbitrary. The display device shown in FIG. 3 is different from the display device shown in FIG. 2 in that a third display driver 1_3 connected with a source line 91_3 of the display panel 90 is additionally provided. Like the first display driver 1_1, the additional third display driver 1_3 includes: a source-line-driving part 20_3; a gradation-voltage-generation part 21_3; a calibration part 30_3; and a gray-scale-reference-voltage-output terminal 83_3; and a calibration-value-input terminal 86_3. In the third display driver 1_3, the gradation-voltage-generation part 21_3 includes the multiplexer 10 shown in FIG. 1; gray scale reference voltages generated inside the gradation-voltage-generation part 21_3 are sequentially selected and output from the gray-scale-reference-voltage-output terminal 83_3. The gray-scale-reference-voltage-output terminals 83_1 and 83_3 of the first display driver 1_1 and the third display driver 1_3 are short-circuited by wiring, and thus connected with the gray-scale-reference-voltage-output terminal 84 of the master (second) display driver 2. To avoid collision of signals, the first display driver 1_1 and the third display driver 1_3 have analog switches 22_1 and 22_3 respectively. Alternatively, separate input terminals may be provided on the master (second) display driver 2.

The slave (first and third) display drivers 1_1 and 1_3 sequentially send out gray scale reference voltages generated by themselves to the master (second) display driver 2 through the gray-scale-reference-voltage-output terminals 83_1 and 83_3. The master (second) display driver 2 sequentially calculates calibration values, and sends back the values to the slave (first and third) display drivers 1_1 and 1_3. On receipt of the calibration values, the slave (first and third) display drivers 1_1 and 1_3 calibrate, based on the calibration values, gray scale reference voltages produced by themselves.

According to the arrangement like this, it is possible to suppress the variation in output voltage between display drivers while minimizing the increase in chip area of the display drivers and the increase in wiring area of a display panel and keeping high noise resistance in a display device including a master (second) display driver and slave (e.g. first and third) display drivers.

<Self-Calibration by the Second Display Driver (Slave) Based on Gray Scale Reference Voltages Transmitted by the First Display Driver (Master)>

Figure 4:
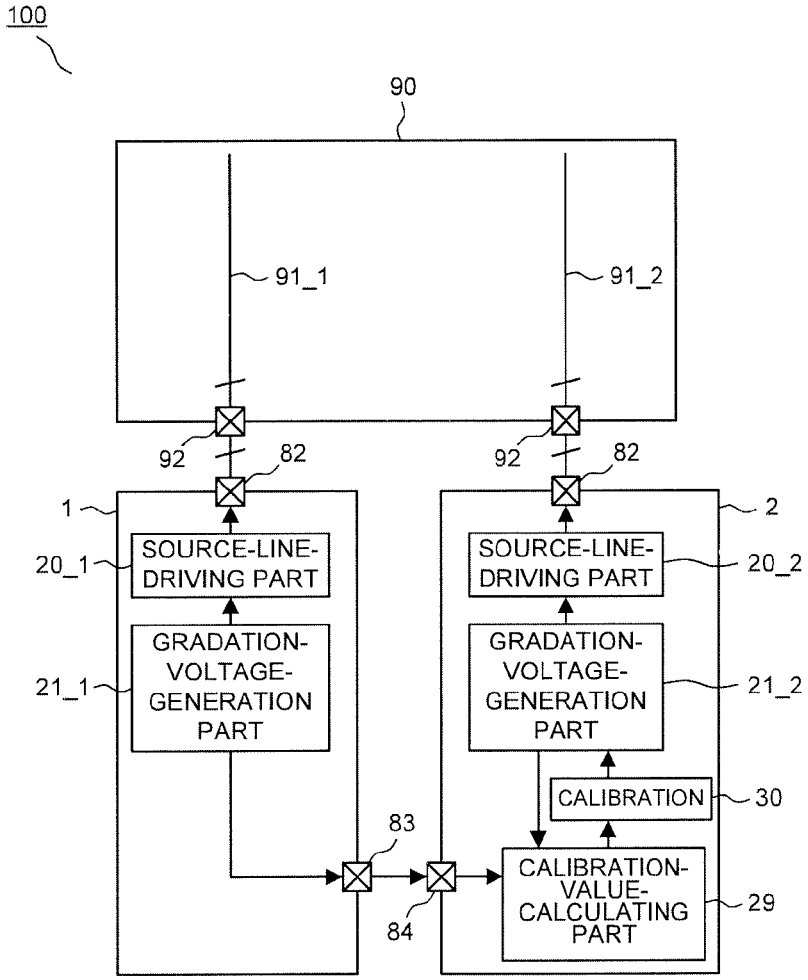
FIG. 4 is a schematic block diagram showing the third example of the configuration of the display device.

FIG. 4 is a schematic block diagram showing the third example of the configuration of the display device. The display device 100 includes: a display panel 90; a first display driver 1 serving as a master; and a second display driver 2 serving as a slave.

The first display driver 1 is connected with a source line 91_1 of the display panel 90 through terminals 82 and 92, whereas the second display driver 2 is connected with a source line 91_2 of the display panel 90 through the terminals 82 and 92.

The first display driver 1 includes a source-line-driving part 20_1, a gradation-voltage-generation part 21_1, and a gray-scale-reference-voltage-output terminal 83. The second display driver 2 includes a source-line-driving part 20_2, a gradation-voltage-generation part 21_2, a calibration-value-calculating part 29, a gray-scale-reference-voltage-input terminal 84, and a calibration part 30. In the first display driver 1, the gradation-voltage-generation part 21_1 includes the multiplexer 10 shown in FIG. 1; gray scale reference voltages generated inside the gradation-voltage-generation part 21_1 are sequentially selected and output through the gray-scale-reference-voltage-output terminal 83.

The second display driver 2 compares, by means of the calibration-value-calculating part 29, gray scale reference voltages sequentially transmitted and received through the gray-scale-reference-voltage-input terminal 84 with corresponding ones of the gray scale reference voltages generated by itself, and calibrates gray scale reference voltages generated by itself based on the result of the comparison by means of the calibration part 30. The slave (second) display driver compares gray scale reference voltages sequentially transmitted from the master (first) display driver with gray scale reference voltages generated by itself, thereby performing calibration so as to make gray scale reference voltages generated by itself coincide with those of the master side.

Thus, it becomes possible to provide a display device arranged so that the slave (second) display driver performs, based on gray scale reference voltages transmitted from the master (first) display driver, autonomous calibration for making gray scale reference voltages generated by itself coincide with those of the master side.

<Parallel Self-Calibration by Slave (e.g. Second and Fourth) Display Drivers>

Figure 5:
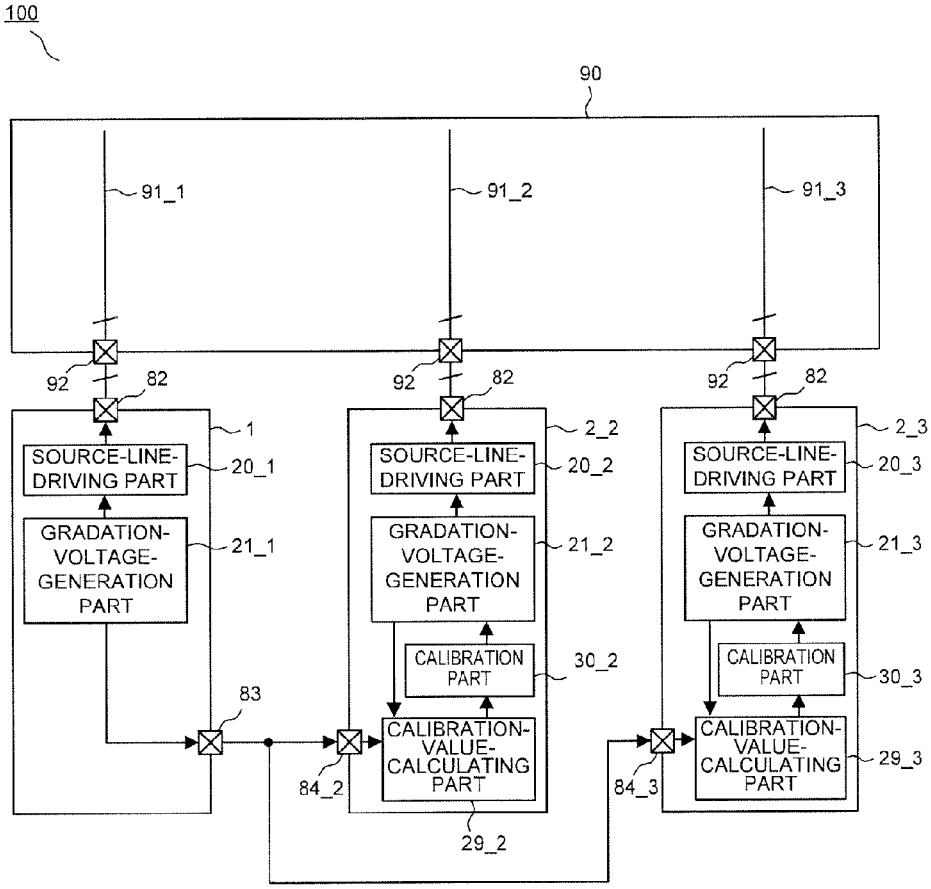
FIG. 5 is a schematic block diagram showing, the fourth example of the configuration of the display device.

FIG. 5 is a schematic block diagram showing the fourth example of the configuration of the display device. Shown as an example of the configuration of the display device having one master (first) display driver 1 and a plurality of slaves is the configuration of a display device having two slaves, i.e. a second display driver 2_2 and a fourth display driver 2_3, provided that the number of the slaves is arbitrary. The display device shown in FIG. 5 is different from the display device shown in FIG. 4 in that a fourth display driver 2_3 connected with a source line 91_3 of the display panel 90 is additionally provided. Like the second display driver 2_2, the additional fourth display driver 2_3 includes: a source-line-driving part 20_3; a gradation-voltage-generation part 21_3; a calibration-value-calculating part 29_3; a gray-scale-reference-voltage-input terminal 84_3; and a calibration part 30_3.

The first display driver 1 which is a master sequentially sends out gray scale reference voltages generated by itself to the second and fourth display drivers 2_2 and 2_3 in parallel through gray-scale-reference-voltage-output terminal 83. The second display driver 2_2 compares, by means of the calibration-value-calculating part 29_2, gray scale reference voltages sequentially transmitted and received through the gray-scale-reference-voltage-input terminal 84_2 with corresponding ones of the gray scale reference voltages generated by itself, and calibrates gray scale reference voltages generated by itself based on the result of the comparison by means of the calibration part 30_2. In parallel with this, the fourth display driver 2_3 compares, by means of the calibration-value-calculating part 29_3, gray scale reference voltages sequentially transmitted and received through the gray-scale-reference-voltage-input terminal 84_3 with corresponding ones of the gray scale reference voltages generated by itself, and calibrates gray scale reference voltages generated by itself based on the result of the comparison by means of the calibration part 30_3. The master (first) display driver 1 sequentially sends out gray scale reference voltages produced by itself to the slave (e.g. second and fourth) display drivers 2_2 and 2_3 in parallel. Then the slave (e.g. second and fourth) display drivers 2_2 and 2_3 each perform calibration to a direction for making gray scale reference voltages produced by themselves coincide received gray scale reference voltages of the master.

According to the arrangement like this, it is possible to suppress the variation in output voltage between display drivers while minimizing the increase in chip area of the display drivers and the increase in wiring area of a display panel and keeping high noise resistance in a display device including a master (first) display driver and slave (e.g. second and fourth) display drivers.

The master and slave display drivers may be materialized as display drivers IC of different types, or as display drivers IC of a single type having two action modes, i.e. a master mode and a slave mode.

In the case of materializing the master and slave display drivers as display drivers IC of different types, it is sufficient in the example shown in FIG. 3 to provide the calibration-value-calculating part which is relatively large in circuit scale only in the master display driver, whereas it is required in the example shown in FIG. 5 to provide the calibration-value-calculating part in each slave display driver. Therefore, the example shown in FIG. 3 is lower in chip cost than the example shown in FIG. 5. Further, the display device is influenced by the variation between the calibration-value-calculating parts provided in the slave display drivers in the example shown in FIG. 5, whereas there is not a problem like that concerning the display device in the example shown in FIG. 3. The same is true for master and slave display drivers materialized as display drivers IC of different types, and for master and slave display drivers materialized as display drivers IC of a single type having two action modes, i.e. a master mode and a slave mode.

In the example shown in FIG. 3, the calibration for slaves must be executed sequentially or in a time-division method. On the other hand, in the example shown in FIG. 5, the calibration can be executed on the slaves in parallel and therefore, the calibration can be executed for a shorter time.

While the gray scale reference voltages are transmitted as analog signals between the display drivers, the comparison for performing calibration may be conducted by any of analog and digital signals. The second to fourth embodiments described below are representative embodiments. In the second and third embodiments, the comparison is performed with digital values for the calibration, whereas in the fourth and fifth embodiments, the comparison is performed with analog voltages for the calibration.

Second Embodiment

Comparison Between Digital Values in the Master with ADC

Figure 6:
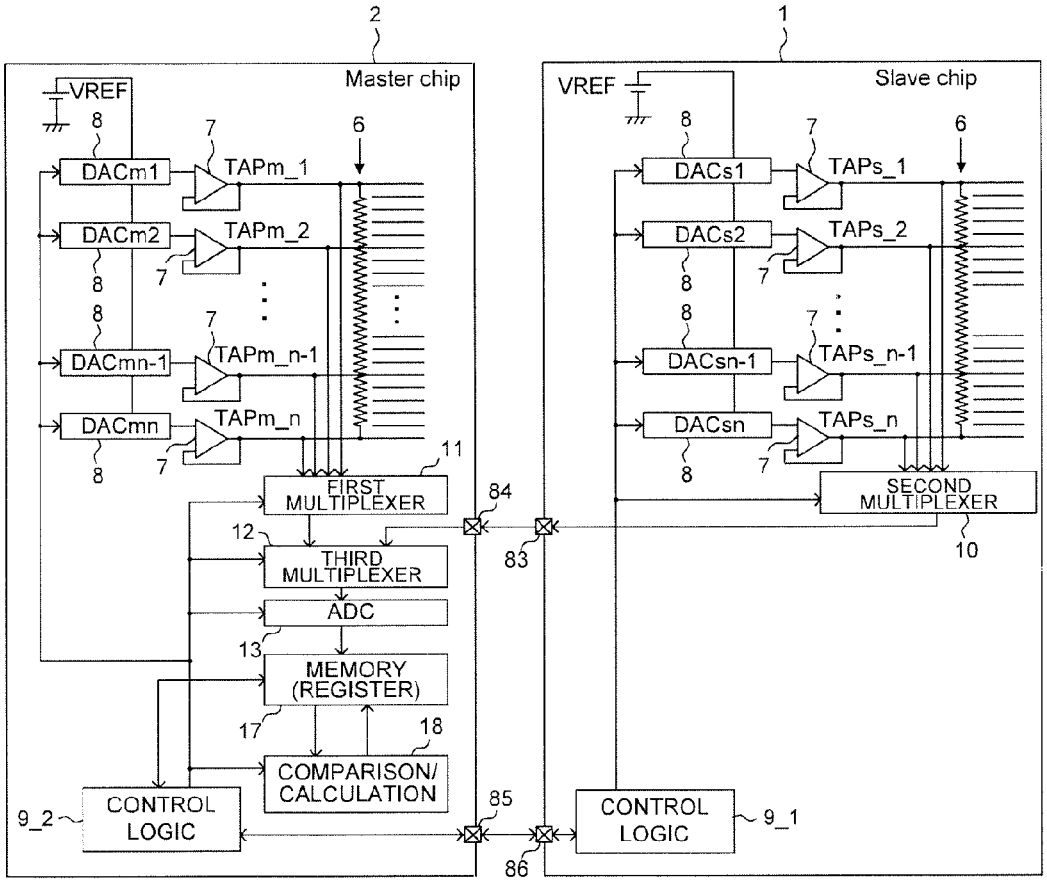
FIG. 6 is a block diagram showing an example of the configuration of display drivers according to the second embodiment of the invention.

FIG. 6 is a block diagram showing an example of the configuration of display drivers according to the second embodiment of the invention.

As described with reference to FIG. 2, the slave display driver 1 sequentially transmits gray scale reference voltages to the master display driver 2; a calibration value is calculated by comparing the received gray scale reference voltages with gray scale reference voltages generated by itself on the master side; and the master display driver 2 sends back the calculated calibration value to the slave display driver 1. In FIG. 6, only the master display driver 2 and the slave display driver 1 are shown, and the diagrammatic representation of the display panel 90 is omitted. In addition, turning to the insides of the display drivers 1 and 2, the diagrammatic representation of the source-line-driving parts 20_1, 20_2, and the like are omitted, and the details of an specific example of the configuration of the calibration-value-calculating part 29 including gradation-voltage-generation parts 21_1 and 21_2 and control circuits (control logics) 9_1 and 9_2 are presented in the diagram. This arrangement can also apply to the display device 100 having one master display driver and a plurality of slave display drivers shown in FIG. 3.

The slave display driver 1, and the master display driver 2 include gradation-voltage-generation parts 21_1 and 21_2 each constituted by a plurality of DA converters 8, a plurality of voltage-follower-power amplifiers 7 and a resistance ladder 6. The voltage-follower-power amplifiers 7 output gray scale reference voltages of respective taps, which are supplied to the resistance ladder 6.

In the slave display driver 1, gray scale reference voltages of respective taps are input to the multiplexer 10, from which one gray scale reference voltage is selected by the control logic 9_1 and then, output through the gray-scale-reference-voltage-output terminal 83.

In the master display driver 2, the calibration-value-calculating part 29 includes: a multiplexer 11; a multiplexer 12; an AD converter 13; a memory 17; a comparison-calculation part 18; and a control logic 9_2. The multiplexers 11 and 12 are each an analog multiplexer which selects one signal from a plurality of signals input thereto, and outputs an analog voltage of the selected signal. The AD converter 13 is a circuit which converts an analog voltage into a digital value. Although no special restriction is intended, e.g. a scheme of a successive comparison type or sigma-delta type is adopted for the AD converter. Although no special restriction is intended, the memory 17 includes e.g. SRAM (Static Random Access Memory) or a register. The comparison-calculation part 18 is arranged to be able to access the memory 17, to perform a calculation of data read out from the memory 17, and to write a result thereof into the memory 17. In case that the control logic 9_2 is composed of a processor such as MPU (Micro Processing Unit), the comparison-calculation part 18 may be mounted as part of its function therein.

Now, the actions of the display drivers 1 and 2 will be described.

In the slave display driver 1, gray scale reference voltages of the respective taps are sequentially selected by the multiplexer 10, and output through the gray-scale-reference-voltage-output terminal 83.

In the master display driver 2, gray scale reference voltages of respective taps are input to the multiplexer 11, from which one gray scale reference voltage is selected by the control logic 9_2, and input to one of input terminals of the multiplexer 12. To the other input terminal of the multiplexer 12, a gray scale reference voltage of the slave display driver 1 is input through the gray-scale-reference-voltage-input terminal 84. The control logic 9_2 selects one of the gray scale reference voltages, and the selected one gray scale reference voltage is input to the AD converter 13 from the multiplexer 12. An output of the AD converter 13 is stored in the memory 17. The comparison-calculation part 18 reads out a gray scale reference voltage thus digitalized, and performs the comparison and calculation thereon, thereby calculating a calibration value.

Gray scale reference voltages generated in the master display driver 2 are sequentially selected by the multiplexer 11, passed through the multiplexer 12, and then input to the AD converter 13, where the gray scale reference voltages are converted into digital values, and the resultant digital values are stored in the memory 17. Also, gray scale reference voltages of the slave display driver 1 input through the gray-scale-reference-voltage-input terminal 84 are sequentially passed through the multiplexer 12 and input to the AD converter 13, where the gray scale reference voltages are converted into digital values, and the resultant digital values are stored in the memory 17. The comparison-calculation part 18 reads out and makes comparison between gray scale reference voltages of the slave display driver 1 and gray scale reference voltages of the master display driver 2 in pairs, and calculates a calibration value of the gray scale reference voltages of the slave display driver 1, provided that each pair of the gray scale reference voltages correspond to each other in their taps. The calibration value thus calculated is passed to the control logic 9_2 and then sent to the master display driver 1 through the calibration-value-output terminal 85. The master display driver 1 having received the calibration value supplies the calibration value to the DA converter 8 of each tap, thereby calibrating the gray scale reference voltages.

Figure 7:
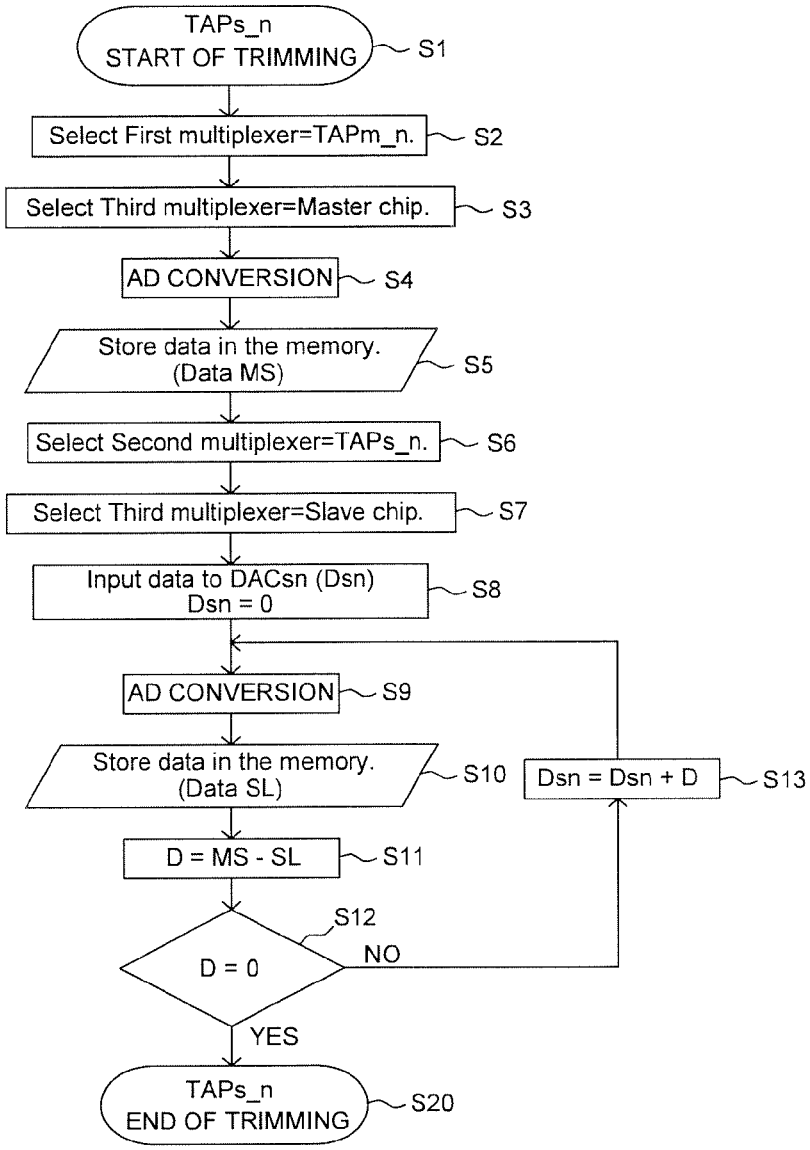
FIG. 7 is a flow diagram showing examples of the actions of the display drivers according to the second embodiment of the invention.

FIG. 7 is a flow diagram showing examples of the actions of the display drivers according to the second embodiment of the invention.

An example of the action in calibrating a gray scale reference voltage of the $n^{-th}$ tap of the slave display driver 1 will be described.

In the master display driver 2, the $n^{-th}$ tap TAPm_n is selected by the multiplexer 11 (S2); the master side is selected by the multiplexer 12 (S3); a gray scale reference voltage of the $n^{-th}$ tap of the master side is input to the AD converter 13, and converted into a digital value (S4); and the result of the conversion (MS) is stored in the memory 17 (S5).

Subsequently, in the slave display driver 1, the $n^{-th}$ tap TAPS_n is selected by the multiplexer 10 (S6); and a gray scale reference voltage of the $n^{-th}$ tap is output through the gray-scale-reference-voltage-output terminal 83. In the master display driver 2, the slave side is selected by the multiplexer 12 (S7). In the slave display driver 1, zero (0) is set as input data Dsn to the DA converter 8 for a gray scale reference voltage of the $n^{-th}$ tap (S8). In the master display driver 2, a gray scale reference voltage of the $n^{-th}$ tap of the slave side input through the gray-scale-reference-voltage-input terminal 84 is input to the AD converter 13 to convert the gray scale reference voltage into a digital value (S9); and the result (SL) of the conversion is stored in the memory 17 (S10). The data MS of the master side and the data SL of the slave side are read out from the memory 17, and the comparison-calculation part 18 calculates the difference D=MS-SL therebetween (S11). The input data Dsn to the DA converter 8 is corrected by the difference thus calculated (Dsn=Dsn+D) (S13). Until the absolute value of the difference D reaches below a predetermined error, the steps S9 to S13 are repeated (S12). The notation "D=0" in the step S12 of FIG. 7 represents that judgment is made about whether or not the absolute value of the difference D is below the predetermined error. In case that the absolute value of the difference D is below the predetermined error, the calibration for the $n^{-th}$ tap TAPs_n is terminated (S20). If the difference D=0, gray scale reference voltages of the $n^{-th}$ taps of the master and slave coincide with each other. On condition that the difference D falls within a range permitting errors in terms of industries, the gray scale reference voltages of the $n^{-th}$ taps of the master and slave may be regarded as coinciding with each other, thereby terminating the calibration.

By repeating the above steps on all the taps, gray scale reference voltages for all the taps of the slave display driver 1 can be made to coincide with gray scale reference voltages of the corresponding taps of the master display driver 2.

Figure 8:
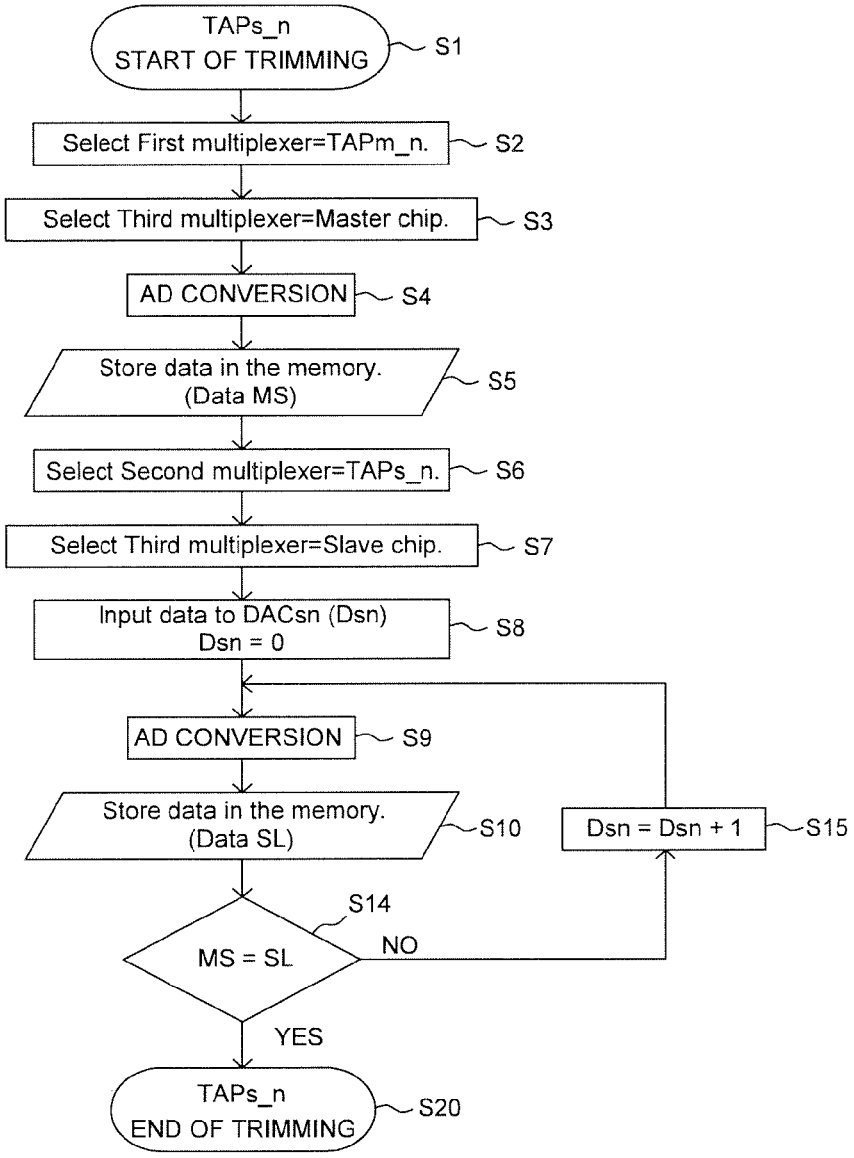
FIG. 8 is a flow diagram showing other examples of the actions of the display drivers according to the second embodiment of the invention.

FIG. 8 is a flow diagram showing other examples of the actions of the display drivers according to the second embodiment of the invention.

As in FIG. 7, there is shown an example of the action in calibrating a gray scale reference voltage of the $n^{-th}$ tap of the slave display driver 1, wherein the steps S1 to S10 are the same as those described above. In the example of the action shown in FIG. 7, the difference D=MS−SL between data MS of the master side and data SL of the slave side is calculated in the step S11, whereas in the action of FIG. 8, judgment is performed about whether or not MS and SL coincide with each other (S14). If MS and SL are not judged to coincide with each other, the input data Dsn of the DA converter 8 of the slave side is incremented by one (1) (S15). The steps S9, S10, S14 and S15 are repeated until the master-side data MS and the slave-side data SL coincide with each other. If they coincide with each other, the action is terminated (S20).

By repeating the above steps for all the taps, a gray scale reference voltage for all the taps of the slave display driver 1 can be made to coincide with a gray scale reference voltage of the corresponding tap of the master display driver 2.

Third Embodiment

Comparison Between Digital Values in the Slave with ADC

Figure 9:
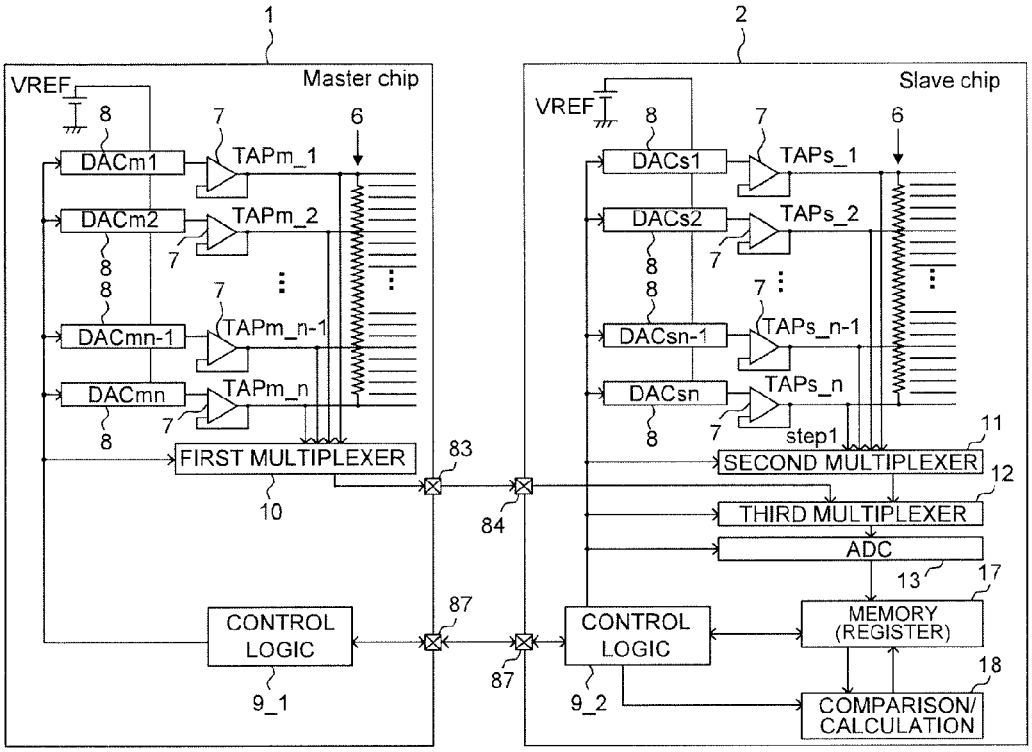
FIG. 9 is a block diagram showing an example of the configuration of display drivers according to the third embodiment of the invention.

FIG. 9 is a block diagram showing an example of the configuration of display drivers according to the third embodiment of the invention.

The configuration is as described with reference to FIG. 4, in which the master display driver 1 sequentially transmits gray scale reference voltages, which provide a reference in the calibration, to the slave display driver 2. Comparison between gray scale reference voltages generated by itself, and received gray scale reference voltages is performed on the slave side, whereby gray scale reference voltages generated by the slave display driver 2 are calibrated. In FIG. 9, only the master display driver 1 and the slave display driver 2 are shown, and the diagrammatic representation of the display panel 90 is omitted. In addition, turning to the insides of the display drivers 1 and 2, the source-line-driving parts 20_1 and 20_2 and the like are omitted, and the details of an specific example of the configuration of gradation-voltage-generation parts 21_1 and 21_2, the calibration-value-calculating part 29 including control circuits (control logics) 9_1 and 9_2, and the calibration part 30 are presented in the diagram. This configuration can be applied to the display device 100 having one master display driver and a plurality of slave display drivers as shown in FIG. 5 in the same way.

The master display driver 1 and the slave display driver 2 include gradation-voltage-generation parts 21_1 and 21_2 each constituted by a plurality of DA converters 8, a plurality of voltage-follower-power amplifiers 7 and a resistance ladder 6. The voltage-follower-power amplifiers 7 output gray scale reference voltages of respective taps, which are supplied to the resistance ladder 6.

In the master display driver 1, gray scale reference voltages of respective taps are input to the multiplexer 10, from which one gray scale reference voltage is selected by the control logic 9_1 and then, output through the gray-scale-reference-voltage-output terminal 83.

In the slave display driver 2, the calibration-value-calculating part 29 and calibration part 30 include: a multiplexer 11; a multiplexer 12; an AD converter 13; a memory 17; a comparison-calculation part 18; and a control logic 9_2. Gray scale reference voltages of the respective taps are input to the multiplexer 11, from which one gray scale reference voltage is selected by the control logic 9_2, and input to one input terminal of the multiplexer 12. To the other input terminal of the multiplexer 12, a gray scale reference voltage of the master display driver 1 is input through the gray-scale-reference-voltage-input terminal 84. One gray scale reference voltage selected by the control logic 9_2 is input to the AD converter 13 from the multiplexer 12. The output of the AD converter 13 is stored in the memory 17. The comparison-calculation part 18 reads out digitalized gray scale reference voltages, performs the comparison and calculation thereof, thereby calculating a calibration value.

The control logic 9_1 and the control logic 9_2 are connected through control information input/output terminals 87 so that mutual communication can be performed. Unlike the second embodiment, it is not required to send or receive a calibration value, so the communication paths are used for synchronization of display.

Now, the action of the display drivers 1 and 2 will be described here.

Gray scale reference voltages generated in the slave display driver 2 are sequentially selected by the multiplexer 11, and passed through the multiplexer 12, and then input to the AD converter 13, where the gray scale reference voltages are converted into digital values; the resultant digital values are stored in the memory 17. Gray scale reference voltages of the master display driver 1 input through the gray-scale-reference-voltage-input terminal 84 are sequentially passed through the multiplexer 12, and input to the AD converter 13, where the gray scale reference voltages are converted into digital values; the resultant digital values are stored in the memory 17. The comparison-calculation part 18 reads out and makes comparison between gray scale reference voltages of the master display driver 1 and gray scale reference voltages of the slave display driver 2 in pairs, and calculates a calibration value of the gray scale reference voltages of the slave display driver 2, provided that each pair of the gray scale reference voltages correspond to each other in their taps. The slave display driver 2 inputs the calculated calibration value to the DA converter 8 of the corresponding tap of the gradation-voltage-generation part 21_2 through the control logic 9_2, thereby calibrating a gray scale reference voltage of the tap.

The actions of the display drivers according to the third embodiment are the same as those of the display drivers according to the second embodiment as described with reference to FIGS. 7 and 8. In the second embodiment, the master display driver 2 executes the actions shown in the flow diagram of FIGS. 7 and 8. With the display drivers according to the third embodiment, the slave display driver 2 performs the actions shown in flow diagrams of FIGS. 7 and 8.

Fourth Embodiment

Comparison Between Analog Voltages in the Master with a Comparator

Figure 10:
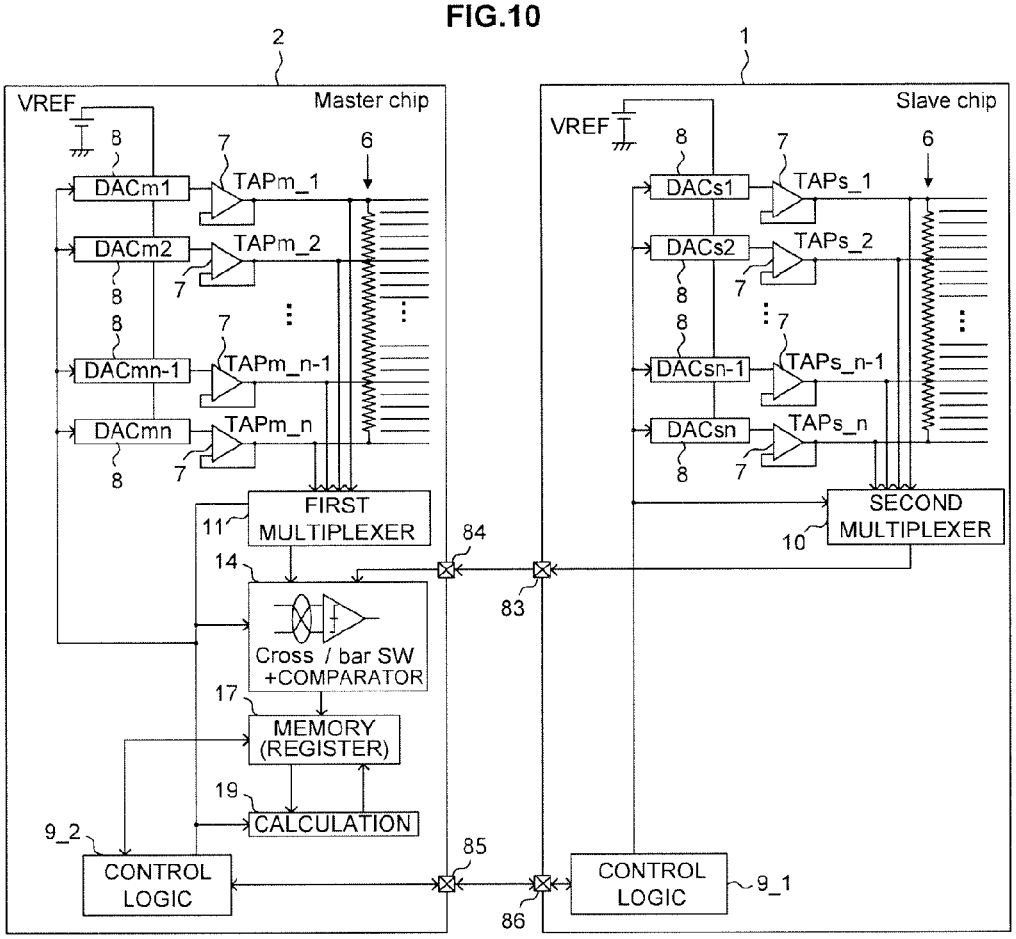
FIG. 10 is a block diagram showing an example of the configuration of display drivers according to the fourth embodiment of the invention.

FIG. 10 is a block diagram showing an example of the configuration of the display drivers according to the fourth embodiment of the invention.

The configuration is as in the second embodiment (FIG. 6) described with reference to FIG. 2, in which the slave display driver 1 sequentially transmits gray scale reference voltages to the master display driver 2; on the master side, a calibration value is calculated by comparing gray scale reference voltages generated by itself with received gray scale reference voltages; and the calculated calibration value is sent back to the slave display driver 1 from the master display driver 2. In the second embodiment (FIG. 6), gray scale reference voltages are digitalized and compared to determine a calibration value, whereas in this embodiment, the comparison is performed between gray scale reference voltages left analog. Only the master display driver 2 and the slave display driver 1 are shown in FIG. 10, and the diagrammatic representation of the display panel 90 is omitted. In addition, turning to the insides of the display drivers 1 and 2, the source-line-driving parts 20_1 and 20_2 and the like are omitted; and the gradation-voltage-generation parts 21_1 and 21_2, and the calibration-value-calculating part 29 including control circuits (control logics) 9_1 and 9_2 are concretely described in detail. The configuration can be likewise applied to a display device 100 having one master display driver and a plurality of slave display drivers, which is shown in FIG. 3.

The slave display driver 1 and the master display driver 2 have gradation-voltage-generation parts 21_1 and 21_2 respectively. The gradation-voltage-generation parts 21_1 and 21_2 each include a plurality of DA converters 8 and a plurality of voltage-follower-power amplifiers 7, and a resistance ladder 6. The voltage-follower-power amplifiers 7 output gray scale reference voltages of respective taps, which are supplied to the resistance ladder 6.

In the slave display driver 1, gray scale reference voltages of the respective taps are input to the multiplexer 10; from which one gray scale reference voltage is selected by the control logic 9_1, and output from the gray-scale-reference-voltage-output terminal 83.

In the master display driver 2, the calibration-value-calculating part 29 includes a multiplexer 11, a comparator 14 with a crossbar switch, a memory 17, a calculation part 19, and a control logic 9_2. The multiplexer 11 accepts input of a gray scale reference voltage of each tap, and the gray scale reference voltage of the tap specified by the control logic 9_2 is supplied to one input of the comparator 14 with the crossbar switch; a gray scale reference voltage of each tap of the slave display driver 1 received through the gray-scale-reference-voltage-input terminal 84 is input to the other input of the comparator 14 with the crossbar switch. An output of the comparator 14 is stored in the memory 17. The calculation part 19 is arranged to be able to access the memory 17, to perform a calculation between data read out from the memory 17, and to write a result of the calculation into the memory 17. The calculation part 19 may be mounted as part of the function of the control logic 9_2 on condition that it is composed of a processor such as MPU.

Figure 11A:
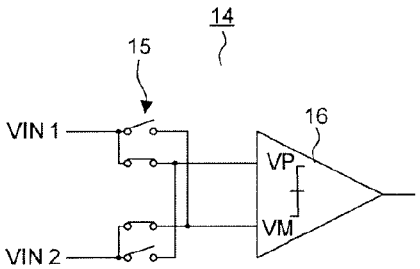
FIGS. 11A and 11B are each a circuit diagram for explaining the action of a comparator with a crossbar switch.
Figure 11B:
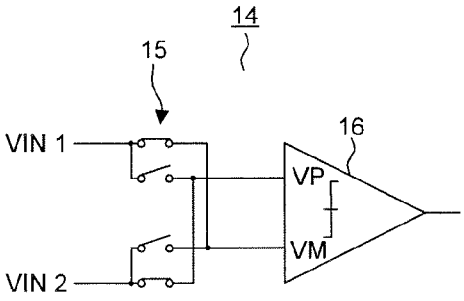

FIGS. 11A and 11B are each a circuit diagram for explaining the action of the comparator 14 with the crossbar switch. As shown in FIGS. 11A and 11B, the crossbar switch 15 is arranged to be able to switch inputs of the comparator 16. In Phase A shown in FIG. 11A, VIN1 is input to VP, whereas VIN2 is input to VM. In contrast, in Phase B shown in 11B, VIN1 is input to VM, and VIN2 is input to VP. The input offset of the comparator 16 can be balanced out by switching the inputs by use of the crossbar switch 15. For instance, first in Phase A, a point where the output of the comparator 16 is inverted is determined while gradually increasing VIN2 with VIN1 fixed. Next, in Phase B, a point where the output of the comparator 16 is inverted is determined while gradually increasing VIN2 with VIN1 fixed in the same way. In case that the comparator 16 has no input offset, the points of inversion in Phase A and Phase B coincide with each other. On the other hand, in case that the comparator 16 involves an input offset, the points of inversion in Phase A and Phase B are in disagreement with each other. The point of inversion with no input offset can be predicted from the intermediate value of the points of inversion in Phase A and Phase B.

According to this method, the input of the offset comparator 16 can be balanced out by use of the comparator 14 with the crossbar switch.

Figure 12:
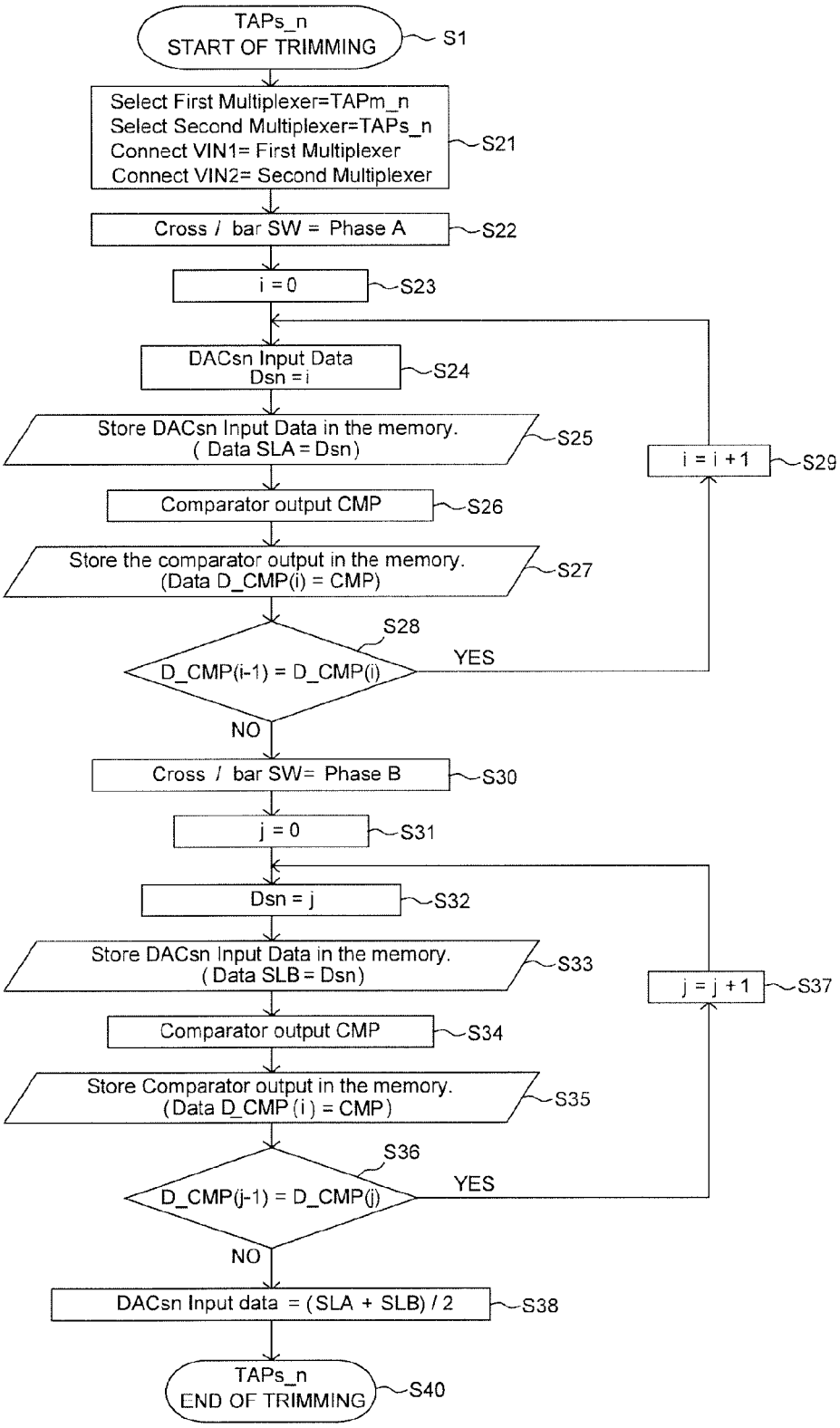
FIG. 12 is a flow diagram showing examples of the actions of the display drivers according to the fourth embodiment of the invention.

FIG. 12 is a flow diagram showing examples of the actions of the display drivers according to the fourth embodiment of the invention.

Now, there is shown an example of the action for calibrating a gray scale reference voltage of the $n^{-th}$ tap of the slave display driver 1.

In the master display driver 2, the $n^{-th}$ tap TAPm_n is selected by the multiplexer 11, whereas in the slave display driver 1, the $n^{-th}$ tap TAPs_n is selected by the multiplexer 10; an output of the multiplexer 11 of the master display driver 2 is supplied to VIN1 of the comparator 14 with the crossbar switch, and an output of the multiplexer 10 of the slave display driver 1 is supplied to VIN2 (S21). The crossbar switch 15 is set to Phase A (S22).

A loop using a parameter i is started. First, the initialization is performed so that i=0 (S23). The parameter i is input as input data Dsn to the DA converter 8 of the $n^{-th}$ tap of the slave display driver 1 (S24). The input data Dsn of the DA converter 8 of the $n^{-th}$ tap is stored in the memory 17 as Data SLA (S25). The comparison is performed by the comparator 14 (S26), and then a comparator output CMP is stored in the memory as the $i^{-th}$ comparator output D_CMP (i) (S27). Comparison is made between an $i-1^{-th}$ comparator output D_CMP (i−1) in the last round of the loop, and an $i^{-th}$ comparator output D_CMP (i) (S28). If they coincide with each other, the parameter i is incremented by (+1) (S29), and the process is returned to the step S24. While incrementing the parameter i by one (1), the steps of the loop is repeated until an $i-1^{-th}$ comparator output D_CMP (i−1) coincides with an $i^{-th}$ comparator output D_CMP (i). At the time when they coincide with each other, the process exits from the loop. At the time of the exit from the loop, input data Dsn of the DA converter 8 at a point where the comparator output D_CMP is inverted in Phase A is held as SLA by the memory 17.

Next, the crossbar switch 15 is set to Phase B (S30), and then the same loop using a parameter j is started. First, the parameter j is initialized as j=0 (S31). The parameter j is input as input data Dsn of the DA converter 8 of the $n^{-th}$ tap of the slave display driver 1 (S32). Input data Dsn to the DA converter 8 of the $n^{-th}$ tap is stored in the memory 17 as data SLB (S33). The comparator 14 performs the comparison (S34). Then, a comparator output CMP is stored as a $j^{-th}$ comparator output D_CMP (j) in the memory (S35). A comparison is made between a $j-1^{-th}$ comparator output D_CMP (j−1) in the last round of the loop, and a $j^{-th}$ comparator output D_CMP (j) (S36). If they coincide with each other, the parameter j is incremented by (+1) (S37), and the process is returned to the step S32. While incrementing the parameter j by one (1), the steps of the loop is repeated until a $j-1^{-th}$ comparator output D_CMP (j−1) coincides with a $j^{-th}$ comparator output D_CMP (j). At the time when they coincide with each other, the process exits from the loop. At the time of the exit from the loop, input data Dsn of the DA converter 8 at a point where the comparator output D_CMP is inverted in Phase B is held as SLB by the memory 17.

The average value of SLA and SLB is calculated as a calibration value of input data Dsn of the DA converter 8 (S38), and then the calibration of the $n^{-th}$ tap TAPs_n is terminated (S40).

By repeating the above steps for all the taps, a gray scale reference voltage can be made to coincide with a gray scale reference voltage of the corresponding tap of the master display driver 2 for all the taps of the slave display driver 1.

Fifth Embodiment

Comparison Between Analog Voltages in the Slave with a Comparator

Figure 13:
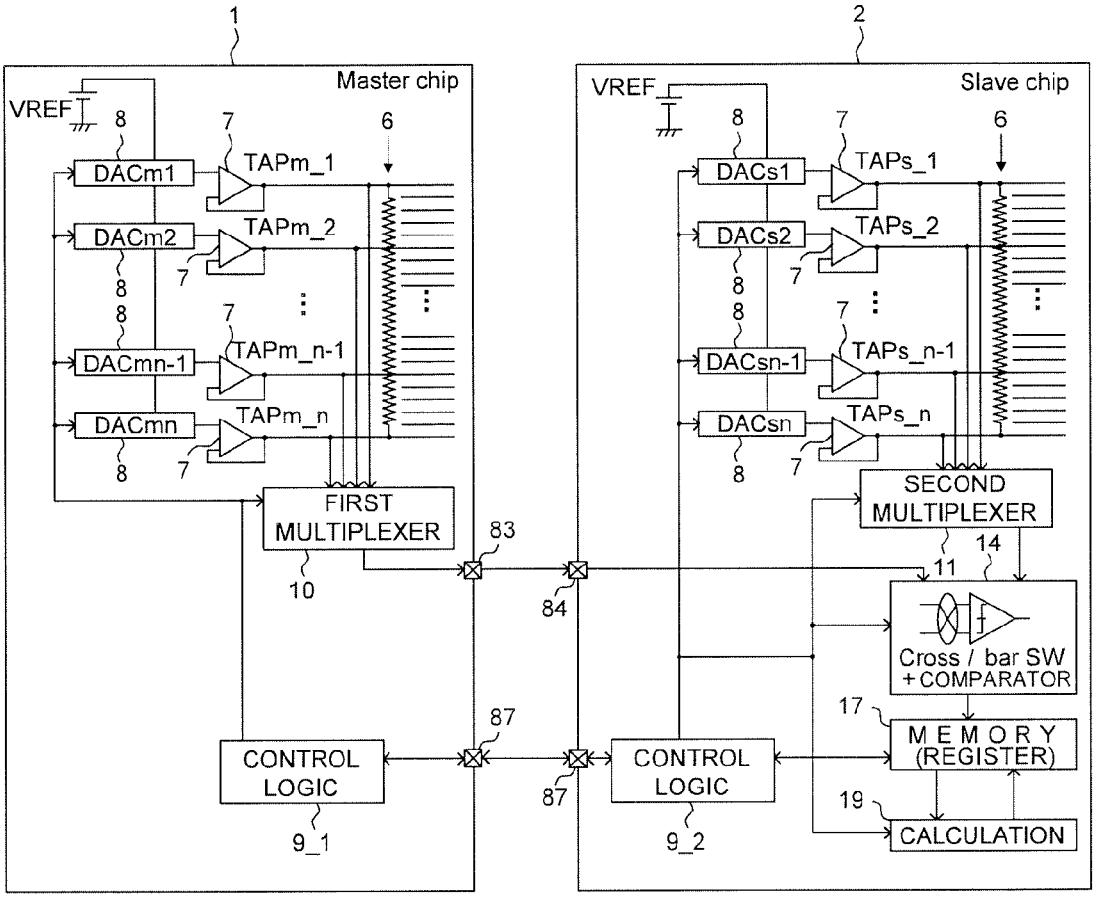
FIG. 13 is a block diagram showing an example of the configuration of display drivers according to the fifth embodiment of the invention.

FIG. 13 is a block diagram showing an example of the configuration of display drivers according to the fifth embodiment of the invention.

The configuration is as in the third embodiment (FIG. 9) described with reference to FIG. 4, in which the master display driver 1 sequentially transmits gray scale reference voltages which provides a reference in the calibration, to the slave display driver 2; on the slave side, gray scale reference voltages generated by the slave display driver 2 are calibrated by comparing gray scale reference voltages generated by itself with received gray scale reference voltages. In the third embodiment (FIG. 9), gray scale reference voltages are digitalized and compared to determine a calibration value, whereas in this embodiment, the comparison is performed between gray scale reference voltages left analog. Only the master display driver 1 and the slave display driver 2 are shown in FIG. 13, and the diagrammatic representation of the display panel 90 is omitted. In addition, turning to the insides of the display drivers 1 and 2, the source-line-driving parts 20_1 and 20_2 and the like are omitted. A concrete example of the configuration of the gradation-voltage-generation parts 21_1 and 212, the calibration-value-calculating part 29 including control circuits (control logics) 9_1 and 9_2, and the calibration part 30 are described in detail. The configuration can be likewise applied to a display device 100 having one master display driver and a plurality of slave display drivers, which is shown in FIG. 5.

The master display driver 1 and the slave display driver 2 include gradation-voltage-generation parts 21_1 and 21_2 each constituted by a plurality of DA converters 8, a plurality of voltage-follower-power amplifiers 7 and a resistance ladder 6. The voltage-follower-power amplifiers 7 output gray scale reference voltages of respective taps, which are supplied to the resistance ladder 6.

In the master display driver 1, gray scale reference voltages of respective taps are input to the multiplexer 10, from which one gray scale reference voltage is selected by the control logic 9_1 and then, output through the gray-scale-reference-voltage-output terminal 83.

In the slave display driver 2, the calibration-value-calculating part 29 and the calibration part 30 include a multiplexer 11, a comparator 14 with a crossbar switch, a memory 17, a calculation part 19, and a control logic 9_2. Gray scale reference voltages of the respective taps are input to the multiplexer 11, and the gray scale reference voltage of the tap specified by the control logic 9_2 is supplied to one input of the comparator 14 with the crossbar switch. To the other input terminal of the comparator 14 with the crossbar switch, gray scale reference voltages of the taps of the master display driver 1 received through the gray-scale-reference-voltage-input terminal 84 are input. An output of the comparator 14 is stored in the memory 17. The calculation part 19 is arranged to be able to access the memory 17, to perform a calculation between data read out from the memory 17, and to write a result of the calculation into the memory 17. The calculation part 19 may be mounted as part of the function of the control logic 9_2 on condition that it is composed of a processor such as MPU.

The control logic 9_1, and the control logic 9_2 are connected so as to be able to communicate with each other through control information input/output terminals 87. Unlike the second embodiment, it is not required to send or receive a calibration value, so the communication paths are used for synchronization of display.

The actions of the display drivers according to the fifth embodiment are similar to the actions of the display drivers according to the fourth embodiment as described with reference to FIG. 12. In the fourth embodiment, the master display driver 2 executes the actions shown by the flow diagram of FIG. 12. On the other hand, in the display drivers according to the fifth embodiment, the slave display driver 2 executes the actions shown by the flow diagram of FIG. 12.

Sixth Embodiment

Slave with S/H Circuit Holds a Reference Voltage from the Master

With the display drivers described in connection with the second to fifth embodiments, the master and slave display drivers are each provided with a plurality of DA converters 8; digital values corresponding to gray scale reference voltages are set on data input thereto, thereby approximating a desired gamma characteristic. Gray scale reference voltages are sequentially transmitted from one of the master side and the slave side to the other side, and the receive side calculates a calibration value, or actually performs the calibration, whereby the action of calibration for making gray scale reference voltages of the slave side coincide with those of the master side is performed.

There is no necessity to hold gray scale reference voltages in the forms of digital values. In the sixth embodiment, a plurality of sample&hold (S/H: Sample and Hold) circuits 23 are provided for the gradation-voltage-generation part 21_2 of the display driver 2 of the slave side instead of the plurality of DA converters 8.

Figure 14:
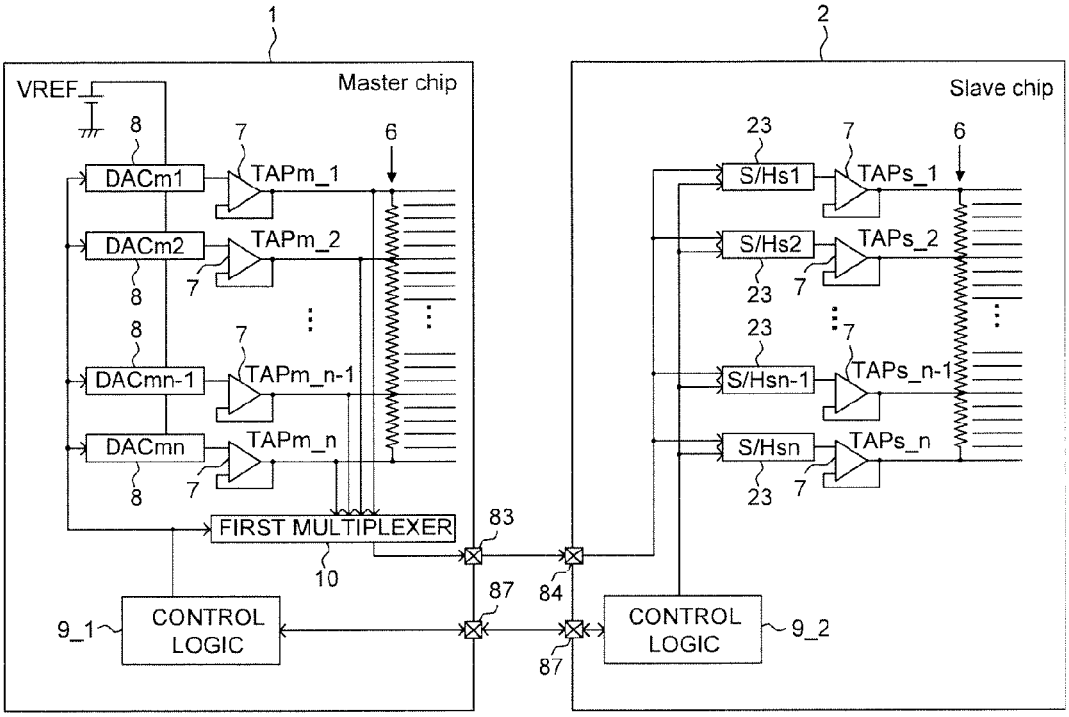
FIG. 14 is a block diagram showing an example of the configuration of display drivers according to the sixth embodiment of the invention.

FIG. 14 is a block diagram showing an example of the configuration of display drivers according to the sixth embodiment of the invention. Only the master display driver 1 and the slave display driver 2 are shown in FIG. 14, and the diagrammatic representation of the display panel 90 is omitted. In addition, turning to the insides of the display drivers 1 and 2, the source-line-driving parts 20_1 and 20_2 and the like are omitted, but a concrete example of the configuration including the gradation-voltage-generation parts 21_1 and 21_2 and the control circuits (control logics) 9_1 and 9_2 are described in detail.

The master display driver 1 has a gradation-voltage-generation part 21_1 which includes a plurality of DA converters 8, a plurality of voltage-follower-power amplifiers 7, and a resistance ladder 6. The voltage-follower-power amplifiers 7 output gray scale reference voltages of the respective taps, which are supplied to the resistance ladder 6. In the master display driver 1, gray scale reference voltages of the taps are input to the multiplexer 10, and one of the gray scale reference voltages selected by the control logic 9_1 is output through the gray-scale-reference-voltage-output terminal 83.

The slave display driver 2 has a gradation-voltage-generation part 21_2 which includes a plurality of sample&hold (S/H) circuits 23, a plurality of voltage-follower-power amplifiers 7 and a resistance ladder 6. Under the control of the control logic 9_2, gray scale reference voltages of the master side input through the gray-scale-reference-voltage-input terminal 84 are sequentially sampled and held by the corresponding sample&hold (S/H) circuits 23.

The control logic 9_1 and the control logic 9_2 are connected so as to be able to communicate with each other through the control information input/output terminals 87. It is not required to send or receive a calibration value, so the communication paths are used for synchronization of transmission of gray scale reference voltages. In addition, the communication paths may be used for synchronization of the display action.

Figure 15:
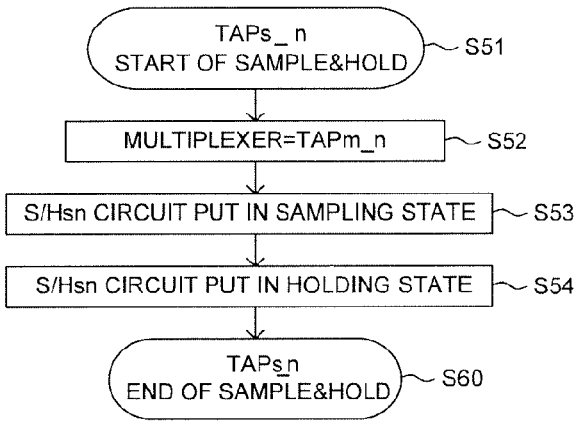
FIG. 15 is a flow diagram showing examples of the actions of the display drivers according to the sixth embodiment of the invention.

FIG. 15 is a flow diagram showing examples of the action of the display drivers according to the sixth embodiment of the invention.

The example of the action shows the case of making a gray scale reference voltage of the $n^{-th}$ tap of the slave display driver 2 coincide with a gray scale reference voltage of the same $n^{-th}$ tap of the master display driver 1.

First, in the master display driver 1, the multiplexer 10 selects the $n^{-th}$ tap (S52). Next, in the slave display driver 2, the corresponding $n^{-th}$ sample&hold circuit S/Hsn is brought to a sampling state (S53). The $n^{-th}$ sample&hold circuit S/Hsn is made to transition to a holding state (S54). Then, the action of sampling and holding a gray scale reference voltage of the $n^{-th}$ tap is completed (S60).

By repeating the above steps for all the taps, the sample&hold circuits of all of the taps of the slave display driver 2 can hold gray scale reference voltages of the corresponding taps of the master display driver 2 in analog.

Thus, it is made possible just by providing a simple circuit to offer a slave display driver capable of performing control so as to copy gray scale reference voltages generated by the master display driver to the slave display driver, and so as to generate gray scale reference voltages comparable to those in the master side.

The sample&hold action is executed in a period before start of the display action after having turned on the display device 100 and then activated the display drivers 1 and 2. After that, the sample&hold action is repeatedly executed in a vertical return (V-blank) period, or in an interval of a line cycle. Sample&hold circuits entail a leak of electric charge and therefore, it is necessary to refresh such circuits.

The invention made by the inventor has been concretely described above based on the embodiments hereof. The invention is not limited to the embodiments. It is obvious that various changes and modifications may be made without departing the subject matter hereof.

For instance, a display device having a liquid crystal display panel has been chiefly described herein while taking examples, whereas the invention can be widely applied to active matrix-type display devices having a gradation voltage for each pixel and driven by a signal. The invention is applicable to e.g. an organic EL (organic electroluminescence display: OELD) display device, a plasma display and others.

What is claimed is:

1. A display device comprising:

a first display driver configured to output gradation signals to source lines of a display panel based on display data; and a second display driver configured to output gradation signals to other source lines of the display panel, wherein the first and second display drivers are each configured to generate gray scale reference voltages for producing gradation signals corresponding to the display data, the gray scale reference voltages having different voltage levels from each other and each corresponding to respective values of the display data, the first display driver is configured to sequentially transmit the gray scale reference voltages generated by itself to the second display driver, and the second display driver is configured to execute calibration for making smaller an absolute value of difference between gray scale reference voltages generated by the first and second display drivers based on the sequentially transmitted gray scale reference voltages.

2. The display device according to claim 1, wherein the second display driver is configured to compare the sequentially transmitted gray scale reference voltages with corresponding ones of the gray scale reference voltages generated by itself, to calculate a calibration value based on a result of the comparison, and to transmit the calibration value to the first display driver, and the first display driver is configured to change gray scale reference voltages generated by itself based on the transmitted calibration value.

3. The display device according to claim 2, further comprising:

a third display driver configured to output gradation signals to source lines of the display panel different from the source lines to which the first and second display drivers output gradation voltages, wherein the third display driver is configured to generate gray scale reference voltages for producing gradation signals corresponding to the display data, the third display driver is configured to sequentially transmit the gray scale reference voltages generated by itself to the second display driver, the second display driver is configured to compare the sequentially transmitted gray scale reference voltages with corresponding ones of the gray scale reference voltages generated by itself, to calculate a calibration value based on a result of the comparison, and to transmit the calibration value to the third display driver, and the third display driver is arranged to change gray scale reference voltages generated by itself based on the transmitted calibration value.

4. The display device according to claim 1, wherein the second display driver is configured to compare the sequentially transmitted gray scale reference voltages with corresponding ones of the gray scale reference voltages generated by itself, and to change gray scale reference voltages generated by itself based on a result of the comparison.

5. The display device according to claim 4, further comprising:

a third display driver configured to output gradation signals to source lines of the display panel different from the source lines to which the first and second display drivers output gradation voltages, wherein the third display driver is configured to generate gray scale reference voltages for producing gradation signals corresponding to the display data, the first display driver is configured to sequentially transmit the gray scale reference voltages generated by itself to the second and third display drivers in parallel, and the third display driver is configured to compare the sequentially transmitted gray scale reference voltages with corresponding ones of the gray scale reference voltages generated by itself, and to change gray scale reference voltages generated by itself based on a result of the comparison.

6. The display device according to claim 1, wherein the second display driver includes an analog-to-digital converter, a memory circuit, and a calculation circuit, the analog-to-digital converter is configured to convert gray scale reference voltages generated by the second display driver, and the sequentially transmitted gray scale reference voltages into digital values on an as-needed basis, the memory circuit is configured to store the digital values, and the calculation circuit is configured to execute the calculation by reading out digital values stored in the memory circuit, and to execute a comparison and/or division.

7. The display device according to claim 1, wherein the second display driver includes an analog comparator, a memory circuit, and a calculation circuit, the analog comparator is configured to compare gray scale reference voltages generated by the second display driver with the transmitted gray scale reference voltages respectively, the memory circuit is configured to store a result of the comparison; and the calculation circuit is configured to execute the calibration by reading out results of the comparison stored in the memory circuit, and to execute a calculation.

8. The display device according to claim 7, wherein the second display driver further includes a switch configured to mutually switch between inputs of the analog comparator to each other, in a case that gray scale reference voltages generated by the second display driver are input to one input terminal of the analog comparator, and the transmitted gray scale reference voltages are input to another input terminal of the analog comparator, a first comparison result is stored in the memory circuit, in a case that as a result of switching the switch, the transmitted gray scale reference voltages are input to the one input terminal of the analog comparator, and gray scale reference voltages generated by the second display driver are input to the other input terminal of the analog comparator, a second comparison result is stored in the memory circuit, and the calculation circuit is configured to execute the calibration based on the first and the second comparison results.

9. The display device according to claim 1, wherein the calibration can be executed at power-on.

10. The display device according to claim 9, wherein the calibration can be further executed during a line-return period of display.

11. The display device according to claim 1, further comprising a non-volatile memory configured to hold a result of the calibration.

12. The display device according to claim 1, wherein the second display driver includes sample&hold circuits corresponding to the gray scale reference voltages, and is configured to sample and hold the transmitted gray scale reference voltages in the corresponding sample&hold circuits, and the second display driver is configured to generate its own gray scale reference voltages based on the held gray scale reference voltages.

13. A display driver:

wherein the display driver is configured to output gradation signals to a group of source lines of a display panel based on display data, the display driver is configured to be mounted on a display device together with an additional display driver configured to output gradation signals to a second group of source lines of the display panel, each of the display driver and the additional display driver is configured to generate gray scale reference voltages for producing gradation signals corresponding to the display data, the gray scale reference voltages having different voltage levels from each other and each corresponding to respective values of the display data, the display driver is configured to sequentially transmit the gray scale reference voltages generated by itself to the additional display driver, and at least one of the display driver and the additional display driver is configured to execute calibration so as to make smaller the absolute value of difference between gray scale reference voltages generated by the display drivers based on the transmitted gray scale reference voltages.

14. The display driver according to claim 13, wherein the additional display driver is configured to calculate a calibration value in order to make smaller the absolute value of the difference by comparing the transmitted gray scale reference voltages with gray scale reference voltages generated by itself; and to transmit the calibration value to the display driver, and the display driver is configured to calibrate the gray scale reference voltages generated by itself based on the transmitted calibration value.

15. The display driver according to claim 13, wherein the additional display driver is configured to calibrate the gray scale reference voltages generated by itself in order to make smaller the absolute value of the difference by comparing the transmitted gray scale reference voltages with gray scale reference voltages generated by itself.

16. The display driver according to claim 13, further comprising a non-volatile memory configured to hold a result of the calibration.

17. The display driver, according to claim 13, formed on a single semiconductor substrate.

18. A display driver:

wherein the display driver is configured to output gradation signals to a group of source lines of a display panel based on display data, wherein the display driver is configured to be mounted on a display device together with an additional display driver configured to output gradation signals to a second group of source lines of the display panel, each of the display driver and the additional display driver is configured to generate gray scale reference voltages for producing gradation signals corresponding to the display data, the gray scale reference voltages having different voltage levels from each other and each corresponding to respective values of the display data, the display driver is configured to sequentially receive the generated gray scale reference voltages from the additional display driver, and to compare received gray scale reference voltages with gray scale reference voltages generated by itself, and at least one of the display driver and the additional display driver is configured to execute calibration so as to make smaller the absolute value of difference between gray scale reference voltages generated by the display drivers based on a result of the comparison.

19. The display driver according to claim 18, wherein the display driver is configured to calculate, based on the comparison result, a calibration value for making smaller the absolute value of difference between gray scale reference voltages generated by the display divers, and to transmit the calibration value to the additional display driver, and the additional display driver is configured to calibrate the gray scale reference voltages generated by itself based on the received calibration value.

20. The display driver according to claim 19, comprising:

an analog-to-digital converter;

a memory circuit; and a calculation circuit, wherein the analog-to-digital converter is configured to convert gray scale reference voltages generated by itself and the sequentially transmitted gray scale reference voltages into digital values on an as-needed basis, the memory circuit is configured to store the digital values, and the calculation circuit is configured to execute the calculation by reading out digital values stored in the memory circuit, and to execute a comparison and/or division.

21. The display driver according to claim 19, comprising:

an analog comparator;

a memory circuit; and a calculation circuit, wherein the analog comparator is configured to compare gray scale reference voltages generated by the display driver with the transmitted gray scale reference voltages respectively on an as-needed basis, the memory circuit is configured to store a result of the comparison and the calculation circuit is configured to execute the calibration by reading out results of the comparison stored in the memory circuit, and to execute a calculation.

22. The display driver according to claim 21, further comprising, a switch configured to mutually switch between the inputs of the analog comparator to each other, wherein in a case that gray scale reference voltages generated by the display driver are input to one input terminal of the analog comparator, and the transmitted gray scale reference voltages are input to another input terminal of the analog comparator, a first comparison result is stored in the memory circuit, in a case that as a result of switching the switch, the transmitted gray scale reference voltages are input to the one input terminal of the analog comparator, and gray scale reference voltages generated by the second display driver are input to the other input terminal of the analog comparator, a second comparison result is stored in the memory circuit, and the calculation circuit is configured to execute the calibration based on the first and second comparison results.

23. The display driver according to claim 18, wherein the display driver is configured to calibrate the gray scale reference voltages generated by itself in order to make smaller the absolute value of difference between gray scale reference voltages generated by the display drivers based on the comparison result.

24. A display driver:

wherein the display driver is configured to output gradation signals to a group of source lines of a display panel based on display data, wherein the display driver is configured to be mounted on a display device together with an additional display driver configured to output gradation signals to a group of source lines of a display panel based on display data, each of the display driver and the additional display driver is configured to generate gray scale reference voltages for producing gradation signals corresponding to the display data, the display driver has action modes consisting of a master mode and a slave mode, in the master mode, the display driver is configured to sequentially receive the generated gray scale reference voltages from the additional display driver configured to work in the slave mode, to compare received gray scale reference voltages with gray scale reference voltages generated by itself, and to calculate, based on the comparison result, a calibration value for making smaller the absolute value of difference between gray scale reference voltages generated by the display drivers; and sending out the calibration value to the additional display driver, the additional display driver is configured to calibrate the gray scale reference voltages generated by itself based on the received calibration value, in the slave mode, the display driver is configured to sequentially send out the gray scale reference voltages generated by itself to the additional display driver configured to work in the master mode, the additional display driver is configured to calculate a calibration value in order to make smaller the absolute value of the difference by comparing the transmitted gray scale reference voltages with gray scale reference voltages generated by itself; and to transmit the calibration value to the display driver, and the display driver is configured to calibrate, based on the transmitted calibration value, the gray scale reference voltages generated itself.

25. A display driver:

wherein the display driver is configured to output gradation signals to a group of source lines of a display panel based on display data, wherein the display driver is configured to be mounted on a display device together with an additional display driver configured to output gradation signals to a second group of source lines of the display panel, each of the display driver and the additional display driver is configured to generate gray scale reference voltages for producing gradation signals corresponding to the display data, the gray scale reference voltages having different voltage levels from each other and each corresponding to respective values of the display data, the display driver has action modes consisting of a master mode and a slave mode, in the master mode, the display driver is configured to sequentially transmit the gray scale reference voltages generated by itself to the additional display driver capable to work in a slave mode, the additional display driver is configured to compare the transmitted gray scale reference voltages with gray scale reference voltages generated by itself, thereby calibrating the gray scale reference voltages generated by itself in order to make smaller the absolute value of the difference, in the slave mode, the display driver is configured to receive the generated gray scale reference voltages from the additional display driver capable to work in the master mode, and the display driver is configured to compare received gray scale reference voltages with gray scale reference voltages generated by itself, and to calibrate, based on the comparison result, the gray scale reference voltages generated by itself in order to make smaller the absolute of difference between gray scale reference voltages generated by the display drivers.

* * * * *